US007683314B2

(12) United States Patent
Green et al.

(10) Patent No.: US 7,683,314 B2
(45) Date of Patent: Mar. 23, 2010

(54) MASS SPECTROMETER

(75) Inventors: Martin Green, Cheshire (GB); Jason Lee Wildgoose, Stockport (GB); Steven Derek Pringle, Darwen (GB); Kevin Giles, Cheshire (GB)

(73) Assignee: Micromass UK Limited, Manchester (GB)

( * ) Notice: Subject to any disclaimer, the term of this patent is extended or adjusted under 35 U.S.C. 154(b) by 437 days.

(21) Appl. No.: 10/599,572

(22) PCT Filed: Apr. 4, 2005

(86) PCT No.: PCT/GB2005/001290

§ 371 (c)(1),
(2), (4) Date: Jun. 7, 2007

(87) PCT Pub. No.: WO2005/098899

PCT Pub. Date: Oct. 20, 2005

(65) Prior Publication Data

US 2007/0284521 A1 Dec. 13, 2007

Related U.S. Application Data

(60) Provisional application No. 60/573,468, filed on May 21, 2004.

(30) Foreign Application Priority Data

Apr. 5, 2004 (GB) ..... 0407713.7
May 21, 2004 (GB) ..... 0411372.6

(51) Int. Cl.
*H01J 49/04* (2006.01)

(52) U.S. Cl. ..... 250/288; 250/281; 250/282; 250/287; 436/173

(58) Field of Classification Search ..... 250/281, 250/282, 283, 286, 287, 288; 436/173
See application file for complete search history.

(56) References Cited

U.S. PATENT DOCUMENTS

| | | | | | |
|---|---|---|---|---|---|
| 3,588,495 | A | * | 6/1971 | Halliday | 250/283 |
| 3,600,573 | A | * | 8/1971 | Watanabe | 250/286 |
| 3,920,985 | A | * | 11/1975 | Hiller et al. | 250/281 |
| 4,160,161 | A | * | 7/1979 | Horton | 250/281 |
| 5,073,713 | A | * | 12/1991 | Smith et al. | 250/282 |
| 5,083,020 | A | * | 1/1992 | Takahashi | 250/288 |
| 5,347,126 | A | * | 9/1994 | Krauss et al. | 850/52 |
| 5,747,800 | A | * | 5/1998 | Yano et al. | 250/292 |

(Continued)

FOREIGN PATENT DOCUMENTS

EP 1215711 A2 * 6/2002

(Continued)

*Primary Examiner*—David A Vanore
*Assistant Examiner*—Michael Maskell
(74) *Attorney, Agent, or Firm*—Jamie H. Rose

(57) ABSTRACT

A mass spectrometer is disclosed comprising an ion beam attenuator which attenuates an ion beam repeatedly switching between a zero transmission mode of operation during a time period ΔT1 and a non-zero transmission mode of operation during a time period $\Delta T_2$. The degree of attenuation of the ion beam can be varied by varying the mark space ratio $\Delta T_2/\Delta T_1$. The ion beam attenuator may release ions in packets or pulses but the packets or pulses of ions may be converted into a continuous ion beam by a relatively high pressure ion guide or gas collision cell arranged downstream of the ion beam attenuator.

4 Claims, 13 Drawing Sheets

U.S. PATENT DOCUMENTS 6,331,702 B1 * 12/2001 Krutchinsky et al. ..... 250/281
6,870,157 B1 * 3/2005 Zare ..... 250/287
2003/0075678 A1 * 4/2003 Bateman et al. ..... 250/287
2004/0222370 A1 * 11/2004 Bateman et al. ..... 250/281
2004/0232327 A1 * 11/2004 Bateman et al. ..... 250/288

FOREIGN PATENT DOCUMENTS

GB 2388704 A * 11/2003

* cited by examiner

MASS SPECTROMETER

The present invention relates to a mass spectrometer and a method of mass spectrometry.

In many mass spectrometric applications it is desired to analyse complex mixtures of compounds. Individual components within these mixtures may be present with a wide range of relative concentrations. This can give rise to a wide range of ion current intensities which are transmitted to the mass analyser and the ion detector. For many of these applications it is important to produce both quantitative and qualitative data (in the form of exact mass measurement) for as many of the components as possible in a complex mixture. This can place very high demands upon the dynamic range of the mass analyser and the detection system employed in the mass spectrometer.

One known method which has been employed to extend the dynamic range for quantitative and qualitative analysis is to adjust the intensity of the ion beam transmitted to the mass analyser by a pre-determined factor. This ensures that mass spectral data is then only recorded when the ion beam received by the mass analyser does not cause saturation of the mass analyser or ion detector.

In general, known ways of reducing the intensity of an ion beam use either a focusing electrostatic lens or a deflecting electrostatic lens. The electrostatic lens is arranged upstream of a plate or electrode having an aperture. The profile of the ion beam may be expanded by the electrostatic lens, or the ion beam may, for example, be deflected in a direction away from the initial direction of the ion beam such that only a portion of the ion beam is transmitted through the aperture in the plate. The remaining ions strike the surface of the plate. For example, a known arrangement increases the dynamic range by attenuating an ion beam in a low transmission mode of operation by defocusing the ion beam such that the profile of the ion beam exceeds that of an aperture in an exit electrode arranged downstream of an electrostatic lens. Accordingly, in the low transmission mode of operation only a fraction of the ions pass through the aperture in the exit electrode arranged downstream of the electrostatic lens whilst the remaining ions strike the surface of the exit electrode. The reduced intensity ion beam is then mass analysed.

As an alternative to defocusing the ion beam it is known to deflect the ion beam to one side such that in a low transmission mode of operation most of the ion beam impinges upon the exit electrode and only a relatively small proportion of the ion beam is onwardly transmitted past the exit electrode.

The known methods of either defocusing or deflecting an ion beam using an electrostatic lens arrangement to reduce the transmission of an ion beam can suffer from a number of problems.

Firstly, it is difficult to precisely operate the known electrostatic lens arrangement in the known manner such that a desired attenuation of an ion beam is achieved precisely. Generally, the electrostatic lens arrangement must first be calibrated by measuring the transmission of the electrostatic lens arrangement at several different lens conditions in order to empirically determine the relationship between the voltages applied to the electrostatic lens arrangement and the relative transmission of the electrostatic lens arrangement. However, this relationship may also depend upon the settings of other focussing elements in the system. Consequently, it may be necessary to recalibrate the electrostatic lens arrangement at regular intervals in order to ensure an accurate estimation of the relative transmission.

Secondly, the portion of the ion beam which is not allowed to pass through the aperture in the exit electrode will strike the surface of the exit electrode predominantly in the region surrounding the aperture in the exit electrode. This can cause surface charging around the aperture in the exit electrode. As a result, an additional deleterious potential due to surface charging effects may be generated in the region around the aperture in the exit electrode. This additional potential can interfere with ions being transmitted through the aperture in the exit electrode. This in turn can lead to changes in the focussing of the ion beam and as a result the ratio between the high and low transmission modes of operation may suffer from instability.

Thirdly, the known arrangements which either defocus or deflect the ion beam can have the effect of altering the cross-sectional profile of the ion beam, the spatial and angular distributions of the ion beam and the velocity or energy profile of the ion beam. This can affect the subsequent performance, mass resolution and mass calibration of a mass analyser which mass analyses the ion beam transmitted by the electrostatic lens.

Fourthly, if the cross sectional profile of the ion beam passing through the electrostatic lens arrangement varies as a function of mass to charge ratio, then the relative transmission between high and low transmission modes of operation may be different for ions having different mass to charge ratios. This may cause an additional complication in calibrating the effect of the attenuation across a wide range of mass to charge ratios. For example, the cross sectional profile of an ion beam exiting an Electron Impact ("EI") ion source or a Chemical Ionisation ("CI") ion source may vary with respect to mass to charge ratio due to the mass dispersing action of stray magnetic fields from magnets employed to focus the ionising electron beam in the ionisation source. As another example, an ion transfer device utilising AC or RF voltages may have transmission and focussing properties which are dependent, at least to some extent, upon the mass to charge ratio of ions.

It is therefore desired to provide an improved mass spectrometer and method of mass spectrometry.

According to an aspect of the present invention there is provided a mass spectrometer comprising:

an ion beam attenuator for transmitting and attenuating a beam of ions, wherein, in use, the ion beam attenuator is repeatedly switched between a first mode of operation wherein the ion transmission is substantially 0% and a second mode of operation wherein the ion transmission is >0%.

The ion beam attenuator preferably has an average or overall transmission of x %, wherein x is selected from the group consisting of: (i) <0.01; (ii) 0.01-0.05; (iii) 0.05-0.1; (v) 0.1-0.5; (vi) 0.5-1.0; (vii) 1-5; (viii) 5-10; (ix) 10-15; (x) 15-20; (xi) 20-25; (xii) 25-30; (xiii) 30-35; (xiv) 35-40; (xv) 40-45; (xvi) 45-50; (xvii) 50-55; (xviii) 55-60; (xix) 60-65; (xx) 65-70; (xxi) 70-75; (xxii) 75-80; (xxiii) 80-85; (xxiv) 85-90; (xxv) 90-95; and (xxvi) >95.

The ion beam attenuator is preferably switched between the first mode of operation and the second mode of operation with a frequency of: (i) <1 Hz; (ii) 1-10 Hz; (iii) 10-50 Hz; (iv) 50-100 Hz; (v) 100-200 Hz; (vi) 200-300 Hz; (vii) 300-400 Hz; (viii) 400-500 Hz; (ix) 500-600 Hz; (x) 600-700 Hz; (xi) 700-800 Hz; (xii) 800-900 Hz; (xiii) 900-1000 Hz; (xiv) 1-2 kHz; (xv) 2-3 kHz; (xvi) 3-4 kHz; (xvii) 4-5 kHz; (xviii) 5-6 kHz; (xix) 6-7 kHz; (xx) 7-8 kHz; (xxi) 8-9 kHz; (xxii) 9-10 kHz; (xxiii) 10-15 kHz; (xxiv) 15-20 kHz; (xxv) 20-25 kHz; (xxvi) 25-30 kHz; (xxvii) 30-35 kHz; (xxviii) 35-40 kHz; (xxix) 40-45 kHz; (xxx) 45-50 kHz; and (xxxi) >50 kHz.

The ion beam attenuator is preferably operated in the first mode of operation for a time period $\Delta T_1$ and is then operated in the second mode of operation for a time period $\Delta T_2$.

According to the preferred embodiment $\Delta T_1 > \Delta T_2$. However, according to a less preferred embodiment $\Delta T_1 \leqq \Delta T_2$.

The time period $\Delta T_1$ is preferably selected from the group consisting of: (i) <0.1 μs; (ii) 0.1-0.5 μs; (iii) 0.5-1 μs; (iv) 1-50 μs; (v) 50-100 μs; (vi) 100-150 μs; (vii) 150-200 μs; (viii) 200-250 μs; (ix) 250-300 μs; (x) 300-350 μs; (xi) 350-400 μs; (xii) 400-450 μs; (xiii) 450-500 μs; (xiv) 500-550 μs; (xv) 550-600; (xvi) 600-650 μs; (xvii) 650-700 μs; (xviii) 700-750 μs; (xix) 750-800 μs; (xx) 800-850 μs; (xxi) 850-900 μs; (xxii) 900-950 μs; (xxiii) 950-1000 μs; (xxiv) 1-10 ms; (xxv) 10-50 ms; (xxvi) 50-100 ms; (xxvii) >100 ms.

Similarly, the time period $\Delta T_2$ is preferably selected from the group consisting of: (i) <0.1 μs; (ii) 0.1-0.5 μs; (iii) 0.5-1 μs; (iv) 1-50 μs; (v) 50-100 μs; (vi) 100-150 μs; (vii) 150-200 μs; (viii) 200-250 μs; (ix) 250-300 μs; (x) 300-350 μs; (xi) 350-400 μs; (xii) 400-450 μs; (xiii) 450-500 μs; (xiv) 500-550 μs; (xv) 550-600; (xvi) 600-650 μs; (xvii) 650-700 μs; (xviii) 700-750 μs; (xix) 750-800 μs; (xx) 800-850 μs; (xxi) 850-900 μs; (xxii) 900-950 μs; (xxiii) 950-1000 μs; (xxiv) 1-10 ms; (xxv) 10-50 ms; (xxvi) 50-100 ms; (xxvii) >100 ms.

The mass spectrometer preferably further comprises a control device wherein, in use, the control device adjusts either the time period $\Delta T_1$ and/or the time period $\Delta T_2$ in order to adjust or vary the transmission or attenuation of the ion beam attenuator.

According to the preferred embodiment the mark space ratio $\Delta T_2/\Delta T_1$ is adjusted in order to adjust or vary the transmission or attenuation of the ion beam attenuator.

The mass spectrometer preferably further comprises an ion detector wherein in either the first mode of operation and/or the second mode of operation at least a portion of the beam of ions is substantially directed towards the ion detector and wherein the ion detector measures the ion current of the beam of ions.

A control device preferably adjusts or varies either the time period $\Delta T_1$ and/or the time period $\Delta T_2$ based upon an ion current as measured by an ion detector.

According to an embodiment in the event that one or more mass peaks in one or more mass spectra are determined as suffering from saturation effects or are determined as approaching saturation then either the time period $\Delta T_1$ and/or the time period $\Delta T_2$ is adjusted or varied.

According to an embodiment in the event that mass data or mass spectral data are determined as suffering from saturation effects or are determined as approaching saturation then either the time period $\Delta T_1$ and/or the time period $\Delta T_2$ is adjusted or varied.

According to an embodiment in the event of an ion current being determined to exceed a certain level or threshold then either the time period $\Delta T_1$ and/or the time period $\Delta T_2$ is adjusted or varied.

The ion beam attenuator preferably comprises one or more electrostatic lenses. The one or more electrostatic lenses preferably comprise one or more electrodes and wherein one or more first voltages are applied to the electrodes in the first mode of operation and wherein one or more second different voltages are applied to the electrodes in the second mode of operation.

The one or more first voltages preferably fall within a range selected from the group consisting of: (i) ±0-10 V; (ii) ±10-20 V; (iii) ±20-30 V; (iv) ±30-40 V; (v) ±40-50 V; (vi) ±50-60 V; (vii) ±60-70 V; (viii) ±70-80 V; (ix) ±80-90 V; (x) ±90-100 V; (xi) ±100-200 V; (xii) ±200-300 V; (xiii) ±300-400 V; (xiv) ±400-500 V; (xv) ±500-600 V; (xvi) ±600-700 V; (xvii) ±700-800 V; (xviii) ±800-900 V; (xix) ±900-1000 V; (xx) >1000 V; and (xxi) <−1000 V.

The one or more second voltages preferably fall within a range selected from the group consisting of: (i) ±0-10 V; (ii) ±10-20 V; (iii) ±20-30 V; (iv) ±30-40 V; (v) ±40-50 V; (vi) ±50-60 V; (vii) ±60-70 V; (viii) ±70-80 V; (ix) ±80-90 V; (x) ±90-100 V; (xi) ±100-200 V; (xii) ±200-300 V; (xiii) ±300-400 V; (xiv) ±400-500 V; (xv) ±500-600 V; (xvi) ±600-700 V; (xvii) ±700-800 V; (xviii) ±800-900 V; (xix) ±900-1000 V; (xx) >1000 V; and (xxi) <−1000 V.

In the first mode of operation a voltage is preferably applied to one or more electrodes of the ion beam attenuator, wherein the voltage causes an electric field to be generated which acts to retard and/or deflect and/or reflect and/or divert the beam of ions.

The one or more electrostatic lenses preferably comprise at least first and preferably second and further preferably third electrodes or at least first and preferably second and further preferably third pairs of electrodes. In the first mode of operation a voltage is preferably applied to either the first and/or the second and/or the third electrodes or to the first and/or the second and/or the third pair of electrodes of the ion beam attenuator, wherein the voltage causes an electric field to be generated which acts to retard and/or deflect and/or reflect and/or divert the beam of ions. According to other embodiments the ion gate or ion beam attenuator may comprise different numbers or pairings of electrodes.

The ion beam attenuator preferably further comprises a differential pumping exit electrode or plate. The differential pumping exit electrode or plate preferably has an aperture having an area selected from the group consisting of: (i) <1 $mm^2$; (ii) 1-2 $mm^2$; (iii) 2-3 $mm^2$; (iv) 3-4 $mm^2$; (v) 4-5 $mm^2$; (vi) 5-6 $mm^2$; (vii) 6-7 $mm^2$; (viii) 7-8 $mm^2$; (ix) 8-9 $mm^2$; (x) 9-10 $mm^2$; and (xi) >10 $mm^2$. According to other embodiments the differential pumping exit electrode or plate may have a circular or non-circular profile and may have a different sized aperture to the preferred embodiment described above.

In the first mode of operation the beam of ions is preferably retarded and/or reflected and/or deflected and/or diverted. In the second mode of operation the beam of ions is preferably substantially unretarded and/or not reflected and/or undeflected and/or undiverted.

According to a less preferred embodiment the ion beam attenuator may comprise a mechanical shutter or mechanical ion beam attenuator. According to an alternative less preferred embodiment the ion beam attenuator may comprise a magnetic ion gate or magnetic ion beam attenuator.

The mass spectrometer preferably further comprises one or more mass filters arranged upstream and/or downstream of the ion beam attenuator.

The mass spectrometer preferably further comprises one or more ion guides or one or more gas collision cells arranged upstream and/or downstream of the ion beam attenuator. The one or more ion guides or gas collision cells are preferably maintained, in use, at a pressure selected from the group consisting of: (i) <0.001 mbar; (ii) 0.001-0.005 mbar; (iii) 0.005-0.01 mbar; (iv) 0.01-0.05 mbar; (v) 0.05-0.1 mbar; (vi) 0.1-0.5 mbar; (vii) 0.5-1 mbar; and (viii) >1 mbar. According to other embodiments the one or more ion guides or gas collision cells may be provided at other pressures to the preferred pressure ranges detailed above.

The one or more ion guides or gas collision cells preferably act to convert a pulsed or non-continous ion beam into a substantially continuous, pseudo-continuous or near continuous ion beam.

According to an embodiment one or more axial DC potential gradients are maintained along at least 5%, 10%, 15%, 20%, 25%, 30%, 35%, 40%, 45%, 50%, 55%, 60%, 65%, 70%, 75%, 80%, 85%, 90%, 95% or 100% of the one or more ion guides or gas collision cells.

According to an embodiment one or more time varying DC potentials or DC potential waveforms are applied to at least a portion of the one or more ion guides or gas collision cells so that at least some ions are urged along the one or more ion guides or gas collision cells.

According to an embodiment one or more axial trapping regions are provided within the one or more ion guides or gas collision cells and wherein the one or more axial trapping regions are translated along at least a portion of the one or more ion guides or gas collision cells.

Preferably, the one or more ion guides or gas collision cells are selected from the group consisting of: (i) an RF or AC multipole rod set ion guide or gas collision cell; (ii) a segmented RF or AC multipole rod set ion guide or gas collision cell; (iii) an RF or AC ion tunnel ion guide or gas collision cell comprising a plurality of electrodes having apertures through which ions are transmitted in use and wherein preferably at least 50% of the electrodes have substantially similar sized apertures; and (iv) an RF or AC ion funnel ion guide or gas collision cell comprising a plurality of electrodes having apertures through which ions are transmitted in use and wherein preferably at least 50% of the electrodes have apertures which become progressively larger or smaller. Other embodiments are contemplated wherein the ion tunnel ion guide or gas collision cell are such that less than 50% of the electrodes have substantially similar sized apertures. Similarly, embodiments are contemplated wherein the ion funnel ion guide or gas collision cell is such that less than 50% of the electrodes have apertures which become progressively larger or smaller.

The mass spectrometer preferably further comprises a mass analyser. The mass analyser is preferably selected from the group consisting of: (i) an orthogonal acceleration Time of Flight mass analyser; (ii) an axial acceleration Time of Flight mass analyser; (iii) a Paul 3D quadrupole ion trap mass analyser; (iv) a 2D or linear quadrupole ion trap mass analyser; (v) a Fourier Transform Ion Cyclotron Resonance mass analyser; (vi) a magnetic sector mass analyser; (vii) a quadrupole mass analyser; and (viii) a Penning trap mass analyser.

The mass analyser preferably mass analyses or acquires, histograms, accumulates, records or outputs mass spectra, mass data or mass spectral data, in use, with a frequency $f_1$ and wherein the ion beam attenuator switches, in use, from the first mode of operation to the second mode of operation with a frequency $f_2$. According to the preferred embodiment the frequency $f_2$ is asynchronous to the frequency $f_1$. Preferably, $f_2>f_1$. Further preferably, the ratio $f_2/f_1$ is at least: (i) 2; (ii) 3; (iv) 4; (v) 5; (vi) 6; (vii) 7; (viii) 8; (ix) 9; (x) 10; (xi) 15; (xii) 20; (xiii) 25; (xiv) 30; (xv) 35; (xvi) 40; (xvii) 45; (xviii) 50; (xix) 55; (xx) 60; (xxi) 65; (xxii) 70; (xxiii) 75; (xxiv) 80; (xxv) 85; (xxvi) 90; (xxvii) 95; (xxviii) 100; (xxix) 110; (xxx) 120; (xxxi) 130; (xxxii) 140; (xxxiv) 150; (xxxv) 160; (xxxvi) 170; (xxxvii) 180; (xxxviii) 190; (xxxix) 200; (xxxx) 250; (xxxxi) 300; (xxxxii) 350; (xxxxiii) 400; (xxxxiv) 450; and (xxxxv) 500. According to a less preferred embodiment $f_2 \leqq f_1$.

The mass spectrometer preferably further comprises an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; and (xvi) a Nickel-63 radioactive ion source.

According to an aspect of the present invention there is provided a mass spectrometer comprising:

an ion beam attenuator, wherein in use the ion beam attenuator attenuates an ion beam passing through the ion beam attenuator, wherein during one cycle the ion beam attenuator: (a) substantially attenuates the ion beam for a time period $\Delta T_1$ during which time the transmission of ions exiting the ion beam attenuator is substantially 0%; and then (b) substantially transmits the ion beam for a time period $\Delta T_2$ so that ions exit the ion beam attenuator.

The mass spectrometer preferably further comprises a control device for adjusting the mark space ratio $\Delta T_2/\Delta T_1$ in order to adjust or vary the degree of attenuation or transmission of the ion beam attenuator.

According to an aspect of the present invention there is provided a mass spectrometer comprising:

an ion beam attenuator for attenuating a beam of ions, wherein, in use, the ion beam attenuator is repeatedly switched between a first mode of operation and a second mode of operation; and a mass analyser arranged to receive an attenuated beam of ions from the ion beam attenuator, wherein in use the mass analyser mass analyses or acquires, histograms, accumulates, records or outputs mass spectra, mass data or mass spectral data in an asynchronous manner to the switching between modes of the ion beam attenuator.

According to an aspect of the present invention there is provided a mass spectrometer comprising:

an ion beam attenuator for attenuating a beam of ions, wherein, in use, the ion beam attenuator is repeatedly switched between a first mode of operation and a second mode of operation at a first frequency; and a mass analyser arranged to received an attenuated beam of ions from the ion beam attenuator, wherein in use the mass analyser mass analyses or acquires, histograms, accumulates, records or outputs mass spectra, mass data or mass spectral data with or at a second frequency, wherein the first frequency is greater than the second frequency.

Preferably, the first frequency is at least 10, 20, 30, 40, 50, 60, 70, 80, 90 or 100 times greater than the second frequency.

According to an aspect of the present invention there is provided a mass spectrometer comprising:

an ion beam attenuator;

an ion guide or gas collision cell arranged downstream of the ion beam attenuator, the ion guide or gas collision cell being arranged to convert a non-continuous beam of ions into a substantially continuous beam of ions; and a mass analyser arranged downstream of the ion guide or gas collision cell;

wherein, in use, the ion beam attenuator is switched between a first mode of operation and a second mode of operation at least 10, 20, 30, 40, 50, 60, 70, 80, 90 or 100 times faster than the mass analyser mass analyses or acquires, histograms, accumulates, records or outputs mass spectra, mass data or mass spectral data.

According to an aspect of the present invention there is provided a mass spectrometer comprising:

an ion beam attenuator for attenuating an ion beam by an attenuation factor wherein, in use, the ion beam attenuator is repeatedly switched ON and OFF and wherein when the ion beam attenuator is switched ON ions are attenuated substantially 100%; and a control device for altering or varying the ratio of the time that the ion beam attenuator is ON to the time that the ion beam attenuator is OFF in order to vary the attenuation factor.

According to an aspect of the present invention there is provided a mass spectrometer comprising:

a device for repeatedly (a) chopping, blocking or 100% deflecting or retarding an ion beam and then (b) transmitting the ion beam, wherein the device is arranged to attenuate the ion beam.

According to an aspect of the present invention there is provided a mass spectrometer comprising:

a device for attenuating an ion beam wherein the degree of attenuation of the ion beam is determined by setting a mark space ratio of the device.

According to an aspect of the present invention there is provided a mass spectrometer comprising:

an ion bean attenuator wherein the ion beam attenuator releases, in use, packets or pulses of ions; and an ion guide or gas collision cell arranged downstream of the ion beam attenuator, wherein the ion guide or gas collision cell substantially converts or smoothes the packets or pulses of ions into a continuous or pseudo-continuous ion beam.

The mass spectrometer preferably further comprises:

means for repeatedly switching the ion beam attenuator ON and OFF; and means for varying the mark space ratio of a switching cycle, wherein the mark space ratio is the ratio of the time period during which an ion beam is attenuated to the time period during which an ion beam is transmitted.

According to an aspect of the present invention there is provided a method of mass spectrometry comprising:

repeatedly switching an ion beam attenuator between a first mode of operation wherein the ion transmission is substantially 0% and a second mode of operation wherein the ion transmission is >0%.

According to an aspect of the present invention there is provided a method of mass spectrometry comprising:

attenuating an ion beam passing through an ion beam attenuator, wherein during one cycle the ion beam attenuator: (a) substantially attenuates the ion beam for a time period $\Delta T_1$ during which time the transmission of ions exiting the ion beam attenuator is substantially 0%; and then (b) substantially transmits the ion beam for a time period $\Delta T_2$ so that ions exit the ion beam attenuator.

According to an aspect of the present invention there is provided a method of mass spectrometry comprising:

attenuating a beam of ions by repeatedly switching an ion beam attenuator between a first mode of operation and a second mode of operation; and mass analysing or acquiring, histogramming, accumulating, recording or outputting mass spectra, mass data or mass spectral data in an asynchronous manner to the switching between modes of the ion beam attenuator.

According to an aspect of the present invention there is provided a method of mass spectrometry comprising:

attenuating a beam of ions by repeatedly switching an ion beam attenuator between a first mode of operation and a second mode of operation at a first frequency; and mass analysing or acquiring, histogramming, accumulating, recording or outputting mass spectra, mass data or mass spectral data at or with a second frequency, wherein the first frequency is greater than the second frequency.

According to an aspect of the present invention there is provided a method of mass spectrometry comprising:

providing an ion beam attenuator;

providing an ion guide or gas collision cell downstream of the ion beam attenuator to convert a non-continuous beam of ions into a substantially continuous beam of ions;

providing a mass analyser arranged downstream of the ion guide or gas collision cell; and switching the ion beam attenuator between a first mode of operation and a second mode of operation at least 10, 20, 30, 40, 50, 60, 70, 80, 90 or 100 times faster than the mass analyser mass analyses or acquires, histograms, accumulates, records or outputs mass spectra, mass data or mass spectral data.

According to an aspect of the present invention there is provided a method of mass spectrometry comprising:

attenuating an ion beam by an attenuation factor by repeatedly switching an ion beam attenuator ON and OFF and wherein when the ion beam attenuator is switched ON ions are attenuated substantially 100%; and altering or varying the ratio off the time that the ion beam attenuator is ON to the time that the ion beam attenuator is OFF in order to vary the attenuation factor.

According to an aspect of the present invention there is provided a method of mass spectrometry comprising:

repeatedly (a) chopping, blocking or 100% deflecting or retarding an ion beam and then (b) transmitting the ion beam in order to attenuate the ion beam.

According to an aspect of the present invention there is provided a method of mass spectrometry comprising:

attenuating an ion beam wherein the degree of attenuation of the ion beam is determined by setting a mark space ratio of a device.

According to an aspect of the present invention there is provided a method of mass spectrometry comprising;

providing an ion beam attenuator which releases packets or pulses of ions; and providing an ion guide or gas collision cell downstream of the ion beam attenuator which substantially converts or smoothes the packets or pulses of ions into a continuous or pseudo-continuous ion beam.

According to a further aspect of the present invention there is provided a mass spectrometer comprising:

an ion beam attenuator for transmitting and attenuating a beam of ions; and switching means for switching between an attenuation mode of operation wherein an ion beam is attenuated and a non-attenuation mode of operation wherein an ion beam is substantially unattenuated, wherein in the attenuation mode of operation the ion beam attenuator is repeatedly switched between a first mode of operation wherein the ion transmission is substantially 0% and a second mode of operation wherein the ion transmission is >0%.

According to a further aspect of the present invention there is provided a mass spectrometer comprising:

an ion beam attenuator for transmitting and attenuating a beam of ions; and switching means for switching between a first attenuation mode of operation wherein an ion beam is attenuated by a first factor and a second attenuation mode of operation wherein the ion beam is attenuated by a second different factor;

wherein in the first attenuation mode of operation the ion beam attenuator is repeatedly switched between a first mode of operation wherein the ion transmission is substantially 0% and a second mode of operation wherein the ion transmission is >0% with a first mark space ratio; and wherein in the second attenuation mode of operation the ion beam attenuator is repeatedly switched between a first mode of operation wherein the ion transmission is substantially 0% and a second mode of operation wherein the ion transmission is >0% with a second different mark space ratio.

Preferably, in the first attenuation mode of operation the ion beam attenuator has an average or overall transmission of x1%, wherein x1 is selected from the group consisting of: (i) <0.01; (ii) 0.01-0.05; (iii) 0.05-0.1; (v) 0.1-0.5; (vi) 0.5-1.0; (vii) 1-5; (viii) 5-10; (ix) 10-15; (x) 15-20; (xi) 20-25; (xii) 25-30; (xiii) 30-35; (xiv) 35-40; (xv) 40-45; (xvi) 45-50; (xvii) 50-55; (xviii) 55-60; (xix) 60-65; (xx) 65-70; (xxi) 70-75; (xxii) 75-80; (xxiii) 80-85; (xxiv) 85-90; (xxv) 90-95; and (xxvi) >95.

Preferably, in the second attenuation mode of operation the ion beam attenuator has an average or overall transmission of x2%, wherein x2 is selected from the group consisting of: (i) <0.01; (ii) 0.01-0.05; (iii) 0.05-0.1; (v) 0.1-0.5; (vi) 0.5-1.0; (vii) 1-5; (viii) 5-10; (ix) 10-15; (x) 15-20; (xi) 20-25; (xii) 25-30; (xiii) 30-35; (xiv) 35-40; (xv) 40-45; (xvi) 45-50; (xvii) 50-55; (xviii) 55-60; (xix) 60-65; (xx) 65-70; (xxi) 70-75; (xxii) 75-80; (xxiii) 80-85; (xxiv) 85-90; (xxv) 90-95; and (xxvi) >95.

According to a preferred embodiment the mass spectrometer may therefore operate in a mode of operation wherein an ion beam is substantially unattenuated and then the mass spectrometer may switch to a different mode of operation wherein the ion beam is attenuated by operating an ion beam attenuator in a manner according to the preferred embodiment i.e. by repeatedly switching the ion beam attenuator ON and OFF and controlling the overall attenuation of the ion beam by appropriate setting of the mark space ratio.

Similarly, according to a preferred embodiment the mass spectrometer may operate in a mode of operation wherein an ion beam is substantially attenuated by a first factor and then the mass spectrometer switches to a different mode of operation wherein the ion beam is attenuated by a second different factor. In both modes of operation the icon beam attenuator is operated in a manner according to the preferred embodiment i.e. by repeatedly switching the ion beam attenuator ON and OFF and controlling the overall attenuation of the ion beam by appropriate setting of the mark space ratio between being ON and OFF. The attenuation factor is set different in the two modes of operation by setting the mark space ratio to be different between the two modes of operation.

According to an aspect of the present invention there is provided a method of mass spectrometry comprising:

providing an ion beam attenuator for transmitting and attenuating a beam of ions; and switching between an attenuation mode of operation wherein an ion beam is attenuated and a non-attenuation mode of operation wherein an ion beam is substantially unattenuated, wherein in the attenuation mode of operation the ion beam attenuator is repeatedly switched between a first mode of operation wherein the ion transmission is substantially 0% and a second mode of operation wherein the ion transmission is >0%.

According to an aspect of the present invention there is provided a method of mass spectrometry comprising:

providing an ion beam attenuator for transmitting and attenuating a beam of ions; and switching between a first attenuation mode of operation wherein an ion beam is attenuated by a first factor and a second attenuation mode of operation wherein the ion beam is attenuated by a second different factor;

wherein in the first attenuation mode of operation the ion beam attenuator is repeatedly switched between a first mode of operation wherein the ion transmission is substantially 0% and a second mode of operation wherein the ion transmission is >0% with a first mark space ratio; and wherein in the second attenuation mode of operation the ion beam attenuator is repeatedly switched between a first mode of operation wherein the ion transmission is substantially 0% and a second mode of operation wherein the ion transmission is >0% with a second different mark space ratio.

Preferably, in the first attenuation mode of operation the ion beam attenuator has an average or overall transmission of x1%, wherein x1 is selected from the group consisting of: (i) <0.01; (ii) 0.01-0.05; (iii) 0.05-0.1; (v) 0.1-0.5; (vi) 0.5-1.0; (vii) 1-5; (viii) 5-10; (ix) 10-15; (x) 15-20; (xi) 20-25; (xii) 25-30; (xiii) 30-35; (xiv) 35-40; (xv) 40-45; (xvi) 45-50; (xvii) 50-55; (xviii) 55-60; (xix) 60-65; (xx) 65-70; (xxi) 70-75; (xxii) 75-80; (xxiii) 80-85; (xxiv) 85-90; (xxv) 90-95; and (xxvi) >95.

Preferably, in the second attenuation mode of operation the ion beam attenuator has an average or overall transmission of x2%, wherein x2 is selected from the group consisting of: (i) <0.01; (ii) 0.01-0.05; (iii) 0.05-0.1; (v) 0.1-0.5; (vi) 0.5-1.0; (vii) 1-5; (viii) 5-10; (ix) 10-15; (x) 15-20; (xi) 20-25; (xii) 25-30; (xiii) 30-35; (xiv) 35-40; (xv) 40-45; (xvi) 45-50; (xvii) 50-55; (xviii) 55-60; (xix) 60-65; (xx) 65-70; (xxi) 70-75; (xxii) 75-80; (xxiii) 80-85; (xxiv) 85-90; (xxv) 90-95; and (xxvi) >95.

According to an aspect of the present invention there is provided a mass spectrometer comprising:

an ion beam attenuator for transmitting and attenuating a beam of ions;

switching means for switching between an non-attenuation mode of operation wherein an ion beam is unattenuated and an attenuation mode of operation wherein an ion beam is substantially attenuated, wherein in the attenuation mode of operation the ion beam attenuator is repeatedly switched between a first mode of operation wherein the ion transmission is substantially 0% and a second mode of operation wherein the ion transmission is >0%;

a mass analyser downstream of the ion beam attenuator; and a control system;

wherein the mass analyser obtains, in use, first mass spectral data during the non-attenuation mode of operation and second mass spectral data during the attenuation mode of operation; and wherein the control system further:

(a) interrogates the first mass spectral data;

(b) determines whether at least some of the first mass spectral data may have been affected by saturation, distortion or missed counts; and (c) uses at least some of the second mass spectral data instead of at least some of the first mass spectral data if it is determined that at least some of the first mass spectral data has been affected by saturation, distortion or missed counts.

Preferably, the ion beam attenuator is regularly and/or repeatedly switched between the non-attenuation mode of operation and the attenuation mode of operation. For example, the ion beam attenuator may be switched between the non-attenuation mode of operation and the attenuation mode of operation with a frequency of <1 Hz, 1-10 Hz, 10-20 Hz, 20-30 Hz, 30-40 Hz, 40-50 Hz, 50-60 Hz, 60-70 Hz, 70-80 Hz, 80 90 Hz, 90-100 Hz, 100-200 Hz, 200-300 Hz, 300-400 Hz, 400-500 Hz, 500-600 Hz, 600-700 Hz, 700-800 Hz, 800-900 Hz, 900-1000 Hz, 1-10 kHz, 10-20 kHz, 20-30 kHz, 30-40 kHz, 40-50 kHz, 50-60 kHz, 60-70 kHz, 70-80 kHz, 80-90 kHz, 90-100 kHz, 100-200 kHz, 200-300 kHz, 300-400 kHz, 400-500 kHz, 500-600 kHz, 600-700 kHz, 700-800 kHz, 800-900 kHz, 900-1000 kHz or >1 MHz.

According to an aspect of the present invention there is provided a mass spectrometer comprising:

an ion beam attenuator for transmitting and attenuating a beam of ions;

switching means for switching between a first attenuation mode of operation wherein an ion beam is attenuated by a first factor and a second attenuation mode of operation wherein the ion beam is attenuated by a second different factor;

wherein in the first attenuation mode of operation the ion beam attenuator is repeatedly switched between a first mode of operation wherein the ion transmission is substantially 0% and a second mode of operation wherein the ion transmission is >0% with a first mark space ratio; and wherein in the second attenuation mode of operation the ion beam attenuator is repeatedly switched between a first mode of operation wherein the ion transmission is substantially 0% and a second mode of operation wherein the ion transmission is >0% with a second different mark space ratio;

the mass spectrometer further comprising a mass analyser downstream of the ion beam attenuator; and a control system;

wherein the mass analyser obtains, in use, first mass spectral data during the first attenuation mode of operation and second mass spectral data during the second attenuation mode of operation; and wherein the control system further:

(a) interrogates the first mass spectral data;

(b) determines whether at least some of the first mass spectral data may have been affected by saturation, distortion or missed counts; and (c) uses at least some of the second mass spectral data instead of at least some of the first mass spectral data if it is determined that at least some of the first mass spectral data has been affected by saturation, distortion or missed counts.

Preferably, the ion beam attenuator is regularly and/or repeatedly switched between the first attenuation mode of operation and the second attenuation mode of operation. For example, the ion beam attenuator may be switched between the first attenuation mode of operation and the second attenuation mode of operation with a frequency of <1 Hz, 1-10 Hz, 10-20 Hz, 20-30 Hz, 30-40 Hz, 40-50 Hz, 50-60 Hz, 60-70 Hz, 70-80 Hz, 80-90 Hz, 90-100 Hz, 100-200 Hz, 200-300 Hz, 300-400 Hz, 400-500 Hz, 500-600 Hz, 600-700 Hz, 700-800 Hz, 800-900 Hz, 900-1000 Hz, 1-10 kHz, 10-20 kHz, 20-30 kHz, 30-40 kHz, 40-50 kHz, 50-60 kHz, 60-70 kHz, 70-80 kHz, 80-90 kHz, 90-100 kHz, 100-200 kHz, 200-300 kHz, 300-400 kHz, 400-500 kHz, 500-600 kHz, 600-700 kHz, 700-800 kHz, 800-900 kHz, 900-1000 kHz or >1 MHz.

Preferably, in the first attenuation mode of operation the ion beam attenuator has an average or overall transmission of x1%, wherein x1 is selected from the group consisting of: (i) <0.01; (ii) 0.01-0.05; (iii) 0.05-0.1; (v) 0.1-0.5; (vi) 0.5-1.0; (vii) 1-5; (viii) 5-10; (ix) 10-15; (x) 15-20; (xi) 20-25; (xii) 25-30; (xiii) 30-35; (xiv) 35-40; (xv) 40-45; (xvi) 45-50; (xvii) 50-55; (xviii) 55-60; (xix) 60-65; (xx) 65-70; (xxi) 70-75; (xxii) 75-80; (xxiii) 80-85; (xxiv) 85-90; (xxv) 90-95; and (xxvi) >95.

Preferably, in the second attenuation mode of operation the ion beam attenuator has an average or overall transmission of x2%, wherein x2 is selected from the group consisting of: (i) <0.01; (ii) 0.01-0.05; (iii) 0.05-0.1; (v) 0.1-0.5; (vi) 0.5-1.0; (vii) 1-5; (viii) 5-10; (ix) 10-15; (x) 15-20; (xi) 20-25; (xii) 25-30; (xiii) 30-35; (xiv) 35-40; (xv) 40-45; (xvi) 45-50; (xvii) 50-55; (xviii) 55-60; (xix) 60-65; (xx) 65-70; (xxi) 70-75; (xxii) 75-80; (xxiii) 80-85; (xxiv) 85-90; (xxv) 90-95; and (xxvi) >95.

According to an embodiment, the transmission of an axial ion beam may be switched, for example, between 100% and 2% (i.e. 1/50th full transmission) on a scan to scan basis and mass spectral data may be obtained in both modes of operation. Other embodiments are contemplated wherein the ion gate or ion beam attenuator is switched between a mode wherein the ion beam is substantially unattenuated and a mode wherein the ion beam is attenuated by a certain factor i.e. the ion transmission efficiency is <100%. Alternatively, the ion gate or ion beam attenuator may be switched between a mode wherein the ion beam is attenuated by a first factor and another mode wherein the ion beam is attenuated by a second different factor. Independent mass calibrations, single point internal lock mass correction and dead time correction may be applied to both non-attenuated or first attenuation spectra and attenuated or second attenuation spectra in real time at, for example, rates of 10 spectra per second.

At least some of the spectra obtained in a non-attenuation mode or first attenuation mode may be interrogated during the acquisition and any mass peaks which suggest that an ion detector was suffering from saturation, distortion or missed counts may be flagged.

According to an embodiment a mass window centred on a saturated peak having a certain mass to charge ratio may be mapped onto the same mass region in mass spectra obtained in an attenuation mode or second attenuation mode for example obtained before and/or following the higher transmission/sensitivity mass spectrum. The low transmission signal in these two windows may then be averaged and this signal, appropriately multiplied by a sensitivity scaling factor may then substituted for the saturated signal in the high transmission spectra. A final composite mass spectrum may therefore be obtained using both high transmission and low transmission data.

According to the preferred embodiment therefore, at least some data from a high transmission (sensitivity) mass spectrum may be rejected or otherwise discarded and substituted for data from a lower transmission (sensitivity) data set if it is determined that significant ion counts have been lost in the high transmission data set. In further embodiments substantially the whole of the high transmission (sensitivity) data may be rejected in favour of low transmission (sensitivity) data.

There are a number of approaches for determining whether or not high transmission mass spectral data is saturated, distorted or otherwise suffering from missed counts. Firstly, when using a preferred orthogonal acceleration Time of Flight mass analyser, saturation may be considered to have occurred if an individual mass peak in the high transmission data exceeds a predetermined average number of ions per mass to charge ratio value per pushout event (i.e. per mass to charge ratio value per energisation of the pusher electrode). If it does then the high transmission data may be rejected and low transmission data, scaled appropriately, may be used in its place. An alternative approach is to decide if an individual mass spectral peak in the low transmission data exceeds a predetermined average number of ions per pushout event. This is because if an ion detector is heavily saturated in the high transmission mode then the recorded ion intensity may, in such circumstances, actually decline and begin to approach zero. In such circumstances, low transmission data, scaled appropriately may be used instead of the saturated high transmission mass spectral data.

Over and above the mechanisms described above which affect individual mass spectral peaks, counts may be lost from the entire data set due to exceeding the number of recorded events per second which can be transferred from the memory of a Time to Digital Converter across the internal transfer bus. Once this limit is exceeded internal memory within the Time to Digital Converter electronics overflows and data is lost. Counts may also be lost from the entire data set due to the electron multiplication device used in the detection system experiencing a loss of gain once a certain output current is exceeded. Once this output is exceeded the gain will drop. The data set produced will now be incomplete and its integrity compromised.

At the point at which either of these two situations occurs for the high transmission data, the entire high transmission spectra may, in one embodiment, be rejected and substituted in its entirety by low transmission data suitably scaled.

Criteria which may be used to determine whether the high transmission data should be rejected in its entirety include determining whether the Total Ion Current ("TIC") recorded in the high transmission mode exceeds a predetermined transfer bus number of events per second limit. The high transmission data may also be rejected if it is determined that the output current of an electron multiplication device in the high transmission mode exceeds a predetermined value. The output current may be determined from the Total Ion Current recorded in the high transmission mode and the measured gain of the detection system prior to acquisition.

The intensity of a single mass spectral peak or the summation of mass spectral peaks which are present at constant levels in the ion source may also be monitored and may be used to determine whether the high transmission data should be rejected. The monitored mass spectral peak(s) may be residual background ions or a reference compound introduced via a separate inlet at a constant rate. If the intensity of the reference mass spectral peak(s) falls below a certain percentage of its initial value in the high transmission spectrum the entire high transmission spectrum may be rejected and substituted by low transmission data suitably scaled. The acceptable value of intensity within the high transmission data set can be a fixed predetermined value or can be a moving average of intensity monitored during acquisition. In the latter case short-term variations in intensity will result in rejection of high transmission data but longer-term drift in intensity of the internal check peaks will not cause rejection of high transmission data.

As an alternative to interrogating single ion intensities or Total Ion Current in mass spectra as criteria for rejecting the high transmission data, a separate detection device may be installed to monitor the ion current or some known fraction of the ion current, independently of the mass spectrometer's detection system. When this recorded value exceeds a predetermined limit the entire high transmission spectrum may be rejected and substituted in its entirety in favour of low transmission data suitably scaled. In one embodiment this detection device may take the form of an electrode, between the source and the analyser, partially exposed to the primary ion beam on which an induced electric current, proportional to the ion current in this region, may be monitored. In another embodiment, specifically relating to an orthogonal acceleration Time of Flight mass spectrometer, a detector may be positioned behind the pushout region to collect the portion of the axial ion beam not sampled into the time of flight drift region. In each case the measured ion current may be used to determine the Total Ion Current at the detector when each mass spectrum was recorded, and used as a criteria for determining situations when ion counts will be lost from the high transmission data.

Using data from low transmission mass spectra obtained immediately before and immediately after a high transmission mass spectrum improves the statistics of measurement of intensity and centroid by using as much data as possible and gives a better estimate of the intensity which would have appeared in the high transmission data at that time if saturation, distortion or missed counts had not occurred. For GC mass spectrometry the signal intensity rapidly changes as a sample elutes giving rise to chromatographic peaks. The intensity of the two low transmission mass spectra bracketing the high transmission mass spectrum may be significantly different. An average of these will give a more accurate representation of the probable intensity of a mass spectral peak or peaks at the time that the high transmission data was recorded.

However, it is not essential that two low transmission mass spectra are averaged. Dynamic range will still be increased if only one of the mass spectra from the low transmission data set is used for substitution. All the above criteria for stitching data are still valid. The further away in time that the low transmission mass spectrum used for substitution is from the high transmission mass spectrum exhibiting saturation the less accurate will be the estimation of the intensity of the substituted ions.

According to one embodiment, low and high transmission mass spectrum may be acquired, for example, in a 95 ms period with a delay between mass spectra of 5 ms to allow the preferred ion beam attenuator to switch mode. Since every other mass spectrum is actually presented, five mass spectra per second may be displayed.

Preferably, the mass spectrometer further comprises:

an orthogonal acceleration Time of Flight mass analyser comprising an electrode for orthogonally accelerating ions into a drift region, the electrode being repeatedly energised; and wherein the control system determines if an individual mass peak in the first mass spectral data exceeds a first predetermined average number of ions per mass to charge ratio value per energisation of the electrode.

Preferably, the first predetermined average number of ions per mass to charge ratio value per energisation of the electrode is selected from the group consisting of: (i) 1; (ii) 0.01-0.1; (iii) 0.1-0.5; (iv) 0.5-1; (v) 1-1.5; (vi) 1.5-2; (vii) 2-5; and (viii) 5-10.

The mass spectrometer preferably further comprises an orthogonal acceleration Time of Flight mass analyser comprising an electrode for orthogonally accelerating ions into a drift region, the electrode being repeatedly energised; and wherein the control system determines if an individual mass peak in the second mass spectral data exceeds a second predetermined average number of ions per mass to charge ratio value per energisation of the electrode.

Preferably, the second predetermined average number of ions per mass to charge ratio value per energisation of the electrode is selected from the group consisting of: (i) 1/x; (ii) 0.01/x to 0.1/x; (iii) 0.1/x to 0.5/x; (iv) 0.5/x to 1/x; (v) 1/x to 1.5/x; (vi) 1.5/x to 2/x; (vii) 2/x to 5/x; and (viii) 5/x to 10/x, wherein x is the ratio of the difference in sensitivities between the non-attenuation and attenuation modes or the first and second attenuation modes.

Preferably, the control system compares the ratio of the intensity of mass spectral peaks observed in the first mass spectral data with the intensity of corresponding mass spectral peaks observed in the second mass spectral data and determines whether the ratio falls outside a predetermined range.

Preferably, the control system determines whether at least some of the first mass spectral data may have been affected by saturation, distortion or missed counts and monitors the total ion current and determines whether the total ion current exceeds a predetermined level.

Preferably, if the control system determines that substantially all of the first mass spectral data may have been affected by saturation, distortion or missed counts the control system uses the second mass spectral data instead of the first mass spectral data.

Preferably, the control system determines whether the total ion current recorded in the non-attenuation or first attenuation mode exceeds a predetermined limit.

Preferably, the control system determines whether the output current of an electron multiplication device exceeds a predetermined limit.

Preferably, the control system monitors a single mass spectral peak or summation of mass spectral peaks and determines the intensity of the single mass spectral peak or summation of mass spectral peaks.

Preferably, the control system monitors an ion current with a further detection device provided upstream of an ion detector.

According to another aspect of the present invention there is provided a method of mass spectrometry comprising:

providing an ion beam attenuator for transmitting and attenuating a beam of ions; and switching between an non-attenuation mode of operation wherein an ion beam is unattenuated and an attenuation mode of operation wherein an ion beam is substantially attenuated, wherein in the attenuation mode of operation the ion beam attenuator is repeatedly switched between a first mode of operation wherein the ion transmission is substantially 0% and a second mode of operation wherein the ion transmission is >0%;

providing a mass analyser downstream of the ion beam attenuator; and wherein the mass analyser obtains, in use, first mass spectral data during the non-attenuation mode of operation and second mass spectral data during the attenuation mode of operation;

the method further comprising:

interrogating the first mass spectral data;

determining whether at least some of the first mass spectral data may have been affected by saturation, distortion or missed counts; and using at least some of the second mass spectral data instead of at least some of the first mass spectral data if it is determined that at least some of the first mass spectral data has been affected by saturation, distortion or missed counts.

According to another aspect of the present invention there is provided a method of mass spectrometer comprising:

providing an ion beam attenuator for transmitting and attenuating a beam of ions;

switching between a first attenuation mode of operation wherein an ion beam is attenuated by a first factor and a second attenuation mode of operation wherein the ion beam is attenuated by a second different factor;

wherein in the first attenuation mode of operation the ion beam attenuator is repeatedly switched between a first mode of operation wherein the ion transmission is substantially 0% and a second mode of operation wherein the ion transmission is >0% with a first mark space ratio; and wherein in the second attenuation mode of operation the ion beam attenuator is repeatedly switched between a first mode of operation wherein the ion transmission is substantially 0% and a second mode of operation wherein the ion transmission is >0% with a second different mark space ratio;

providing a mass analyser downstream of the ion beam attenuator wherein the mass analyser obtains first mass spectral data during the first attenuation mode of operation and second mass spectral data during the second attenuation mode of operation; and the method further comprising:

interrogating the first mass spectral data;

determining whether at least some of the first mass spectral data may have been affected by saturation, distortion or missed counts; and using at least some of the second mass spectral data instead of at least some of the first mass spectral data if it is determined that at least some of the first mass spectral data has been affected by saturation, distortion or missed counts.

Preferably, in the first attenuation mode of operation the ion beam attenuator has an average or overall transmission of x1%, wherein x1 is selected from the group consisting of: (i) <0.01; (ii) 0.01-0.05; (iii) 0.05-0.1; (v) 0.1-0.5; (vi) 0.5-1.0; (vii) 1-5; (viii) 5-10; (ix) 10-15; (x) 15-20; (xi) 20-25; (xii) 25-30; (xiii) 30-35; (xiv) 35-40; (xv) 40-45; (xvi) 45-50; (xvii) 50-55; (xviii) 55-60; (xix) 60-65; (xx) 65-70; (xxi) 70-75; (xxii) 75-80; (xxiii) 80-85; (xxiv) 85-90; (xxv) 90-95; and (xxvi) >95.

Preferably, in the second attenuation mode of operation the ion beam attenuator has an average or overall transmission of x2%, wherein x2 is selected from the group consisting of: (i) <0.01; (ii) 0.01-0.05; (iii) 0.05-0.1; (v) 0.1-0.5; (vi) 0.5-10.0; (vii) 1-5; (viii) 5-10; (ix) 10-15; (x) 15-20; (xi) 20-25; (xii) 25-30; (xiii) 30-35; (xiv) 35-40; (xv) 40-45; (xvi) 45-50; (xvii) 50-55; (xviii) 55-60; (xix) 60-65; (xx) 65-70; (xxi) 70-75; (xxii) 75-80; (xxiii) 80-85; (xxiv) 85-90; (xv) 90-95; and (xxvi) >95.

Preferably, the step of determining whether at least some of the first mass spectral data may have been affected by saturation, distortion or missed counts comprises:

providing an orthogonal acceleration Time of Flight mass analyser comprising an electrode for orthogonally accelerating ions into a drift region, the electrode being repeatedly energised; and determining if an individual mass peak in the first mass spectral data exceeds a first predetermined average number of ions per mass to charge ratio value per energisation of the electrode.

Preferably, the first predetermined average number of ions per mass to charge ratio value per energisation of the electrode is selected from the group consisting of: (i) 1; (ii) 0.01-0.1; (iii) 0.1-0.5; (iv) 0.5-1; (v) 1-1.5; (vi) 1.5-2; (vii) 2-5; and (viii) 5-10.

Preferably, the step of determining whether at least some of the first mass spectral data may have been affected by saturation, distortion or missed counts comprises:

providing an orthogonal acceleration Time of Flight mass analyser comprising an electrode for orthogonally accelerating ions into a drift region, the electrode being repeatedly energised; and determining if an individual mass peak in the second mass spectral data exceeds a second predetermined average number of ions per mass to charge ratio value per energisation of the electrode.

Preferably, the second predetermined average number of ions per mass to charge ratio value per energisation of the electrode is selected from the group consisting of: (i) 1/x; (ii)

0.01/x to 0.1/x, (iii) 0.1/x to 0.5/x; (iv) 0.5/x to 1/x; (v) 1/x to 1.5/x; (vi) 1.5/x to 2/x; (vii) 2/x to 5/x; and (viii) 5/x to 10/x, wherein x is the ratio of the difference in sensitivities between the non-attenuation and attenuation modes or the first and second attenuation modes.

Preferably, the step of determining whether at least some of the first mass spectral data may have been affected by saturation, distortion or missed counts comprises:

comparing the ratio of the intensity of mass spectral peaks observed in the first mass spectral data with the intensity of corresponding mass spectral peaks observed in the second mass spectral data; and determining whether the ratio falls outside a predetermined range.

Preferably, the step of determining whether at least some of the first mass spectral data may have been affected by saturation, distortion or missed counts comprises:

monitoring the total ion current; and determining whether the total ion current exceeds a predetermined level.

Preferably, the method further comprises:

determining that substantially all of the first mass spectral data may have been affected by saturation, distortion or missed counts; and using the second mass spectral data instead of the first mass spectral data.

Preferably, the step of determining that substantially all of the first mass spectral data may have been affected by saturation, distortion or missed counts comprises:

determining whether the total ion current recorded in the non-attenuation or first attenuation mode exceeds a predetermined limit.

Preferably, the step of determining that substantially all of the first mass spectral data may have been affected by saturation, distortion or missed counts comprises:

determining whether the output current of an electron multiplication device exceeds a predetermined limit.

Preferably, the step of determining that substantially all of the first mass spectral data may have been affected by saturation, distortion or missed counts comprises:

monitoring a single mass spectral peak or summation of mass spectral peaks; and determining the intensity of the single mass spectral peak or summation of mass spectral peaks.

Preferably, the step of determining that substantially all of the first mass spectral data may have been affected by saturation, distortion or missed counts comprises:

monitoring the ion current with a further detection device provided upstream of an ion detector.

The present invention comprises a number of different aspects. According to an aspect an ion gate or ion beam attenuator is provided which operates by repeatedly switching ON and OFF and wherein the mark space ratio determines the degree of attenuation of an ion beam passing through the ion beam attenuator. According to another aspect of the present invention a relatively high pressure ion guide, gas collision cell or other device is preferably provided downstream of a preferred ion beam attenuator to preferably smooth or otherwise convert a non-continuous beam of ions as output from the preferred ion beam attenuator into a substantially continuous or near continuous ion beam. According to another aspect of the present invention the ion beam attenuator is switched, preferably regularly or repeatedly, between a relatively high transmission mode and a relatively low or lower transmission mode. The relatively high transmission mode may be either a mode wherein the ion beam attenuator does not actually attenuate the ion beam (i.e. 100% transmission) or where the ion beam attenuator attenuates the ion beam by a first factor (i.e. <100% transmission). In the relatively low transmission mode the ion beam attenuator attenuates the ion beam to a greater extent or degree than in the high transmission mode. According to a further aspect of the present invention data from a relatively high transmission mode and data from a relatively low transmission mode may be stitched together or otherwise combined to provide a composite mass spectrum, mass spectral data set or mass data set generated from at least two different mass spectra, mass spectral data sets or mass data sets. Alternatively, a determination may be made that the data obtained when the ion beam attenuator, ion gate or mass spectrometer was operating in the relatively high transmission mode is fundamentally corrupted or otherwise suffering from saturation effects in which case the data obtained when the ion beam attenuator, ion gate or mass spectrometer was operating in the relatively low transmission mode may be used instead and relied upon.

Numerous preferred features relating to, for example, the operation of a preferred ion beam attenuator, the nature or form of the preferred ion beam attenuator, the principles of converting a non-continuous ion beam output from a preferred ion beam attenuator into a substantially continuous ion beam, and the different types of mass analysers and ion sources which may employed with the present invention has been described in relation to an aspect of the present invention. However, all of the disclosed preferred features are equally applicable to all the various different aspects of the present invention as claimed and as discussed above and in the description.

The preferred embodiment provides a way of attenuating a continuous ion beam by rapidly gating the transmission of ions between a low (preferably zero or 0%) transmission mode and a high (preferably full or 100%) mode of transmission through an ion gate or ion beam attenuator. A particularly advantageous feature of the preferred embodiment is that the degree of attenuation can preferably be precisely controlled and predicted by varying the time spent by the ion gate or ion beam attenuator in either of the two transmission modes.

In a preferred embodiment the ion transmission may be adjusted using a pulsed ion gate or ion beam attenuator. During a low transmission mode the ion gate or ion beam attenuator is preferably closed and hence preferably substantially, no ions pass through or exit from the ion gate or ion beam attenuator i.e. the attenuation factor is substantially 100% in this mode. During a subsequent period during which the ion gate or ion beam attenuator is preferably open, a large proportion (preferably all) of the ion beam preferably passes through or exits from the ion gate or ion beam attenuator and hence the ion gate or ion beam attenuator preferably has high or full transmission in this mode i.e. the attenuation factor is preferably very low and is further preferably 0%. By changing the mark space ratio of the ion gate or ion beam attenuator between the two different transmission modes the average flux of ions through the ion gate or ion beam attenuator may be precisely adjusted.

The preferred method of controlling the transmission or attenuation of an ion beam preferably overcomes various problems associated with the conventional methods. In particular, the attenuation factor by which the transmission of a beam of ions is reduced may be precisely controlled and predicted. The relative transmission is also directly proportional to the duty cycle of the gating pulse applied to the ion gate or ion beam attenuator, and this negates any requirement for calibration of the attenuating characteristics of the ion gate or ion beam attenuator according to the preferred embodiment.

The preferred ion gate or ion beam attenuator is preferably arranged such that during a zero (or low) transmission mode of operation ions are directed away from and preferably do not impinge upon surfaces which are in close proximity to the ion beam when the ion gate or ion beam attenuator is subsequently in a high or full transmission mode of operation. The ion beam is therefore preferably arranged so as not to impact or impinge around an aperture in an electrode or plate through which ions are subsequently transmitted in a high transmission mode of operation. This significantly reduces the possibility of surface charging effects interfering with the subsequent transmission of an ion beam through the ion gate or ion beam attenuator in a high (or full) transmission mode of operation.

According to the preferred embodiment the ion beam is preferably only transmitted through the ion gate or ion beam attenuator under high or full transmission conditions. Under these conditions the gating device, ion gate or ion beam attenuator is effectively inactive. Thus the overall transmission of an ion beam which results from switching the ion gate or ion beam attenuator between two modes may preferably be reduced preferably without introducing any significant spatial aberrations into the ion beam and preferably without introducing any energy spread into the ion beam as may occur with some conventional arrangements.

Since the ion beam is preferably only transmitted under high or full transmission conditions wherein the gating device, ion gate or ion beam attenuator is preferably inactive, the preferred embodiment results in an ion gate or ion beam attenuator which has a constant attenuation factor with respect to mass to charge ratio even if the ion beam is inhomogeneous with respect to mass to charge ratio. This is a particularly advantageous aspect of the preferred embodiment.

Various embodiments of the present invention will now be described, by way of example only, together with other arrangements given for illustrative purposes only and with reference to the accompanying drawings in which.

Figure 14A:
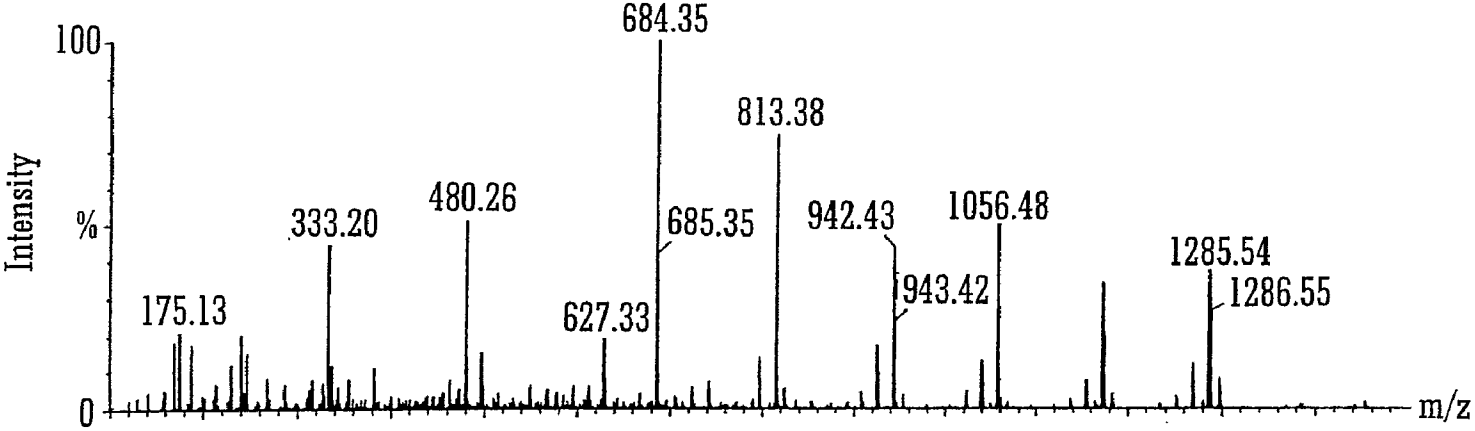
Figure 14B:
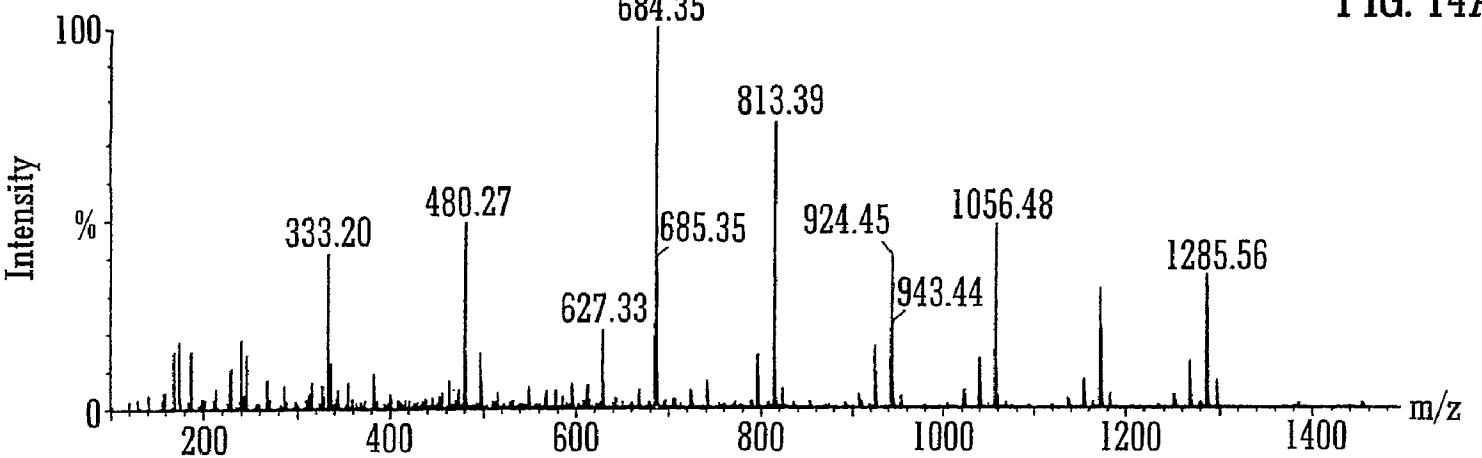
Figure 15A:
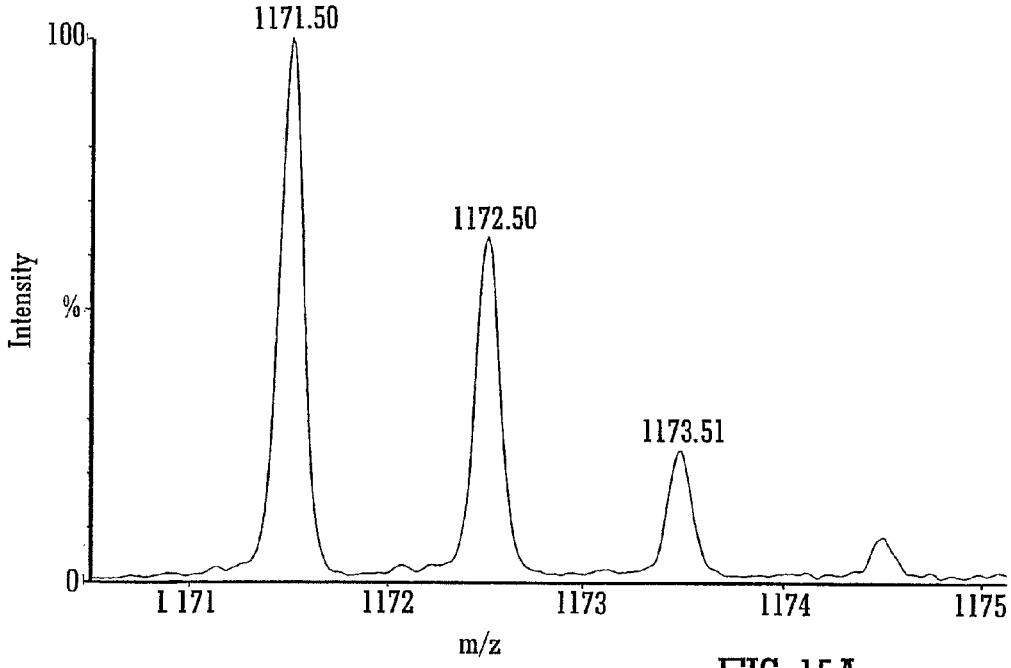
Figure 15B:
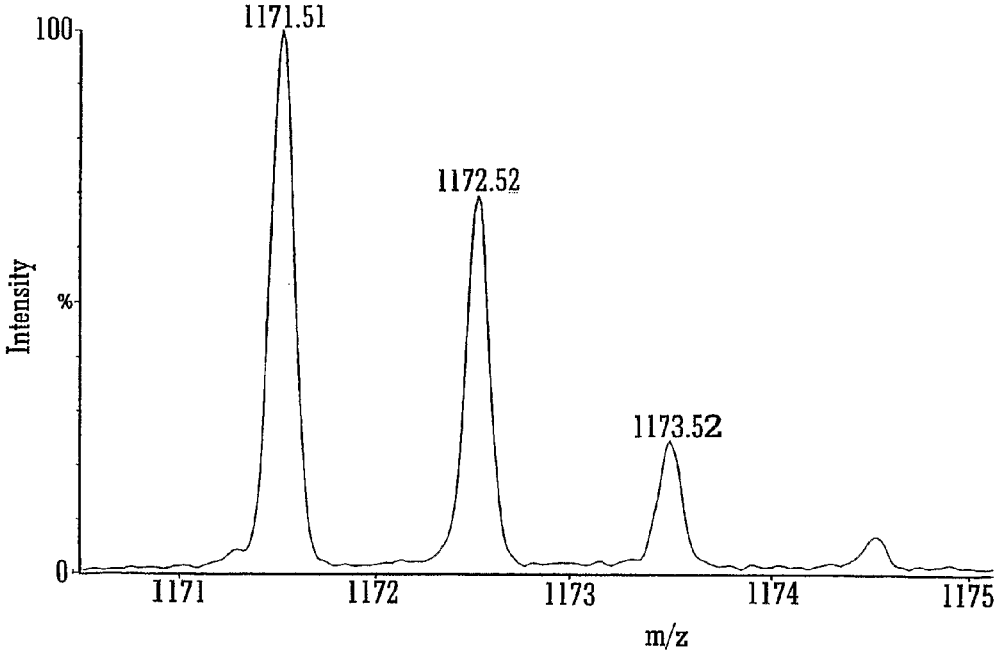

FIG. 14A shows a mass spectrum obtained with a mass spectrometer comprising an Electrospray ion source and FIG. 14B shows a corresponding mass spectrum obtained with a mass spectrometer comprising an Electrospray ion source and a preferred ion gate or ion beam attenuator wherein the ion beam attenuator was used to attenuate the ion beam by 90%; and FIG. 15A shows a portion of the mass spectrum shown in FIG. 14A in greater detail and FIG. 15B shows a portion of the mass spectrum shown in FIG. 14B in greater detail.

Figure 1:
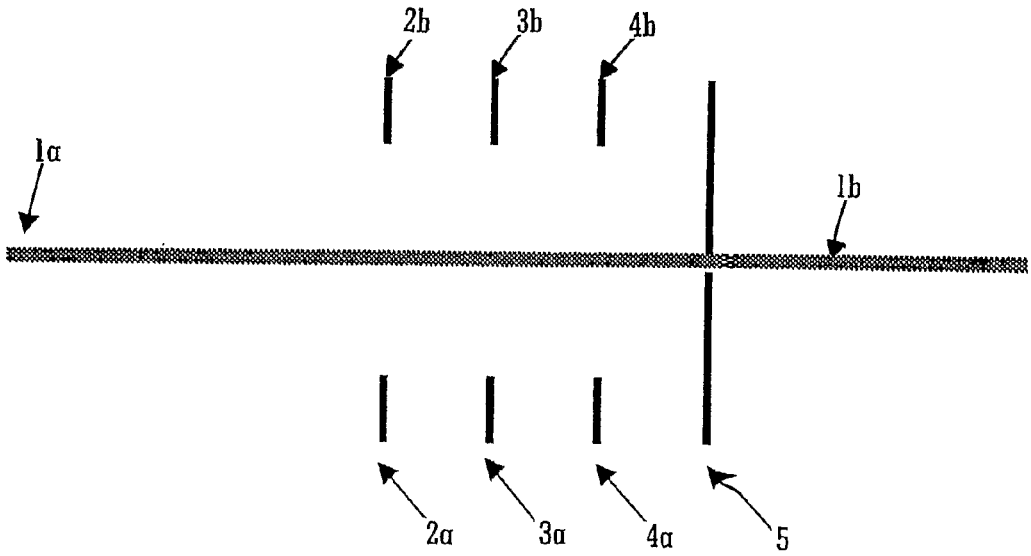
FIG. 1 PRIOR ART
FIG. 1 shows an electrostatic lens arrangement operated in a conventional high transmission mode of operation.

An electrostatic lens arrangement as used conventionally to attenuate an ion beam is shown in FIG. 1. The electrostatic lens arrangement is shown in FIG. 1 in a high transmission mode of operation. A beam of positive ions 1*a* is shown in this mode of operation being transmitted by the electrostatic lens arrangement without being substantially attenuated i.e. the ion beam transmission is substantially 100% and the attenuation factor is 0%. The electrostatic lens arrangement comprises an electrostatic lens assembly comprising a first pair of electrodes 2*a*,2*b*, a second pair of electrodes 3*a*,3*b* and a third pair of electrodes 4*a*,4*b*. A plate or exit electrode 5 is provided downstream of the third pair of electrodes 4*a*,4*b*. The plate or exit electrode 5 has an exit slit or aperture provided therein.

In the high transmission mode of operation the first, second and third pairs of electrodes 2*a*,2*b*,3*a*,3*b*,4*a*,4*b* are all held at nominally identical voltages such that an essentially field free region is provided within the electrostatic lens arrangement. The ion beam 1*a* is transmitted through the exit slit or aperture in the plate or exit electrode 5 without being substantially attenuated and hence the ion beam 1*b* which emerges from the electrostatic lens arrangement has substantially the same intensity as the ion beam 1*a* which is initially incident upon the electrostatic lens arrangement.

Figure 2:
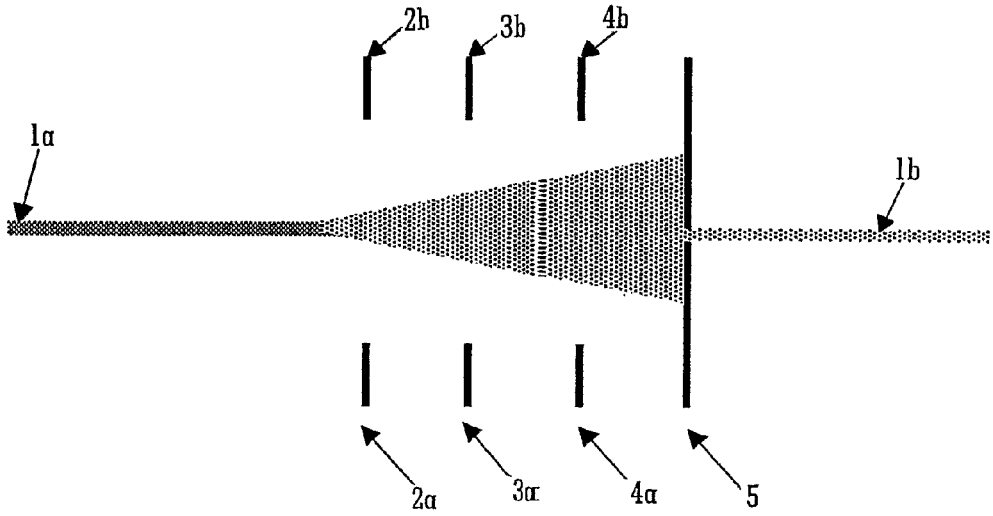
FIG. 2 PRIOR ART
FIG. 2 shows an electrostatic lens arrangement operated in a conventional low transmission mode of operation wherein the ion beam is defocused so that only a relatively small proportion of the ion beam is subsequently transmitted through an aperture in a plate or exit electrode.

FIG. 2 shows the same electrostatic lens arrangement as shown in FIG. 1 but operated in a conventional low transmission mode of operation. According to this mode of operation the second pair of electrodes 3*a*,3*b* are maintained at a voltage which is different to (e.g. higher than) the voltages at which the first and third pairs of electrodes 2*a*,2*b*,4*a*,4*b* and also the plate or exit electrode 5 are maintained. As a result, the ion beam 1*a* passing through the electrostatic lens arrangement is substantially defocused and diverges due to the raised potential at which the second pair of electrodes 3*a*,3*b* are maintained. A large proportion of the ion beam impinges upon the plate or exit electrode 5 and only a relatively small proportion of the ion beam will pass through the aperture in the plate or exit electrode 5 and hence be onwardly transmitted. Accordingly, in this mode of operation the ion transmission is substantially reduced by a certain amount or factor e.g. the ion beam 1*b* which emerges from the electrostatic lens arrangement may, for example, be attenuated by 90% (or by some other amount).

As can be seen from FIG. 2, in the conventional low transmission mode of operation a significant proportion of the ion beam impinges upon the front surface of the plate or exit electrode 5. Furthermore, a significant proportion of these ions will impinge upon the plate or exit electrode 5 in a region close to or immediately surrounding the opening or aperture in the plate or exit electrode 5. As discussed above, the ions which impinge upon the plate or exit electrode 5 can cause surface charging effects which can adversely affect the subsequent transmission of ions through the plate or exit electrode 5 particularly in a subsequent high transmission mode of operation.

Figure 3:
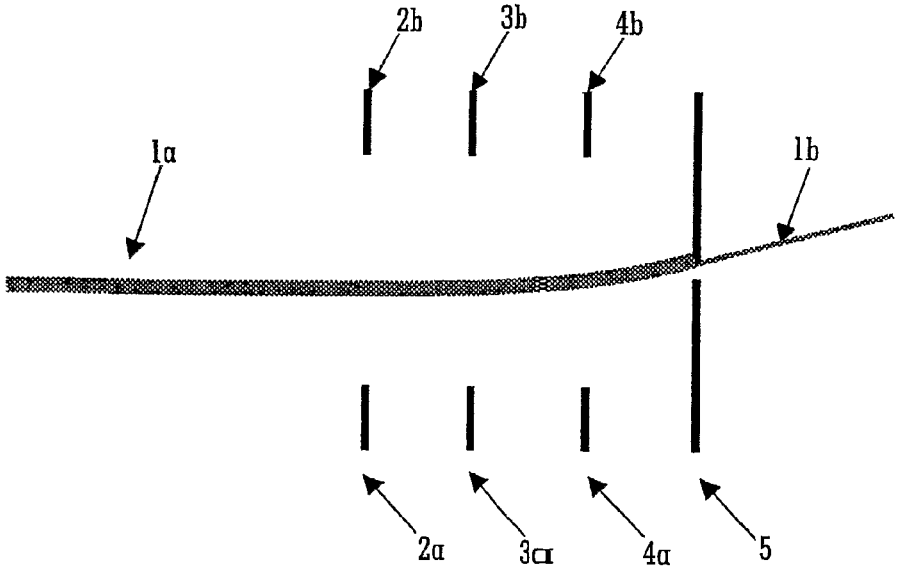
FIG. 3 PRIOR ART
FIG. 3 shows an electrostatic lens arrangement operated in an alternative conventional low transmission mode of operation wherein the ion beam is deflected so that only a relatively small proportion of the ion beam is onwardly transmitted past a plate or exit electrode.

FIG. 3 shows an electrostatic lens arrangement operated in an alternative conventional low transmission mode of operation wherein the second pair of electrodes 3*a*,3*b* are maintained at different voltages relative to each other. In the particular arrangement shown in FIG. 3, one of the second electrodes 3*a* is raised to a voltage which is substantially higher than the voltage applied to the other second electrode 3*b*. The raised voltage which is applied to the second electrode 3*a* is also above the voltages applied to the first and third pairs of electrodes 2*a*,2*b*,4*a*,4*b* and the plate or exit electrode 5. The ion beam is therefore, as a result, deflected away from the second electrode 3*a* which is maintained at a relatively high voltage. As a result, the ion beam is deflected so as to impinge upon the plate or exit electrode 5 in a manner such that only a relatively small proportion of the ion beam is onwardly transmitted past the plate or exit electrode 5. Furthermore, as can be seen from FIG. 3, the ion beam 1*b* which is onwardly transmitted past the plate or exit electrode 5 is substantially off-axis or is otherwise inclined to the direction of travel of the ion beam 1*a* as initially received by the electrostatic lens arrangement. The conventional arrangement shown in FIG. 3 can therefore cause various problems as discussed below.

In the low transmission mode of operation shown in FIG. 3, the ion beam may, for example, be attenuated by 90%. The remainder of the ion beam will be incident upon the front surface of the plate or exit electrode 5 in very close proximity to the opening or aperture in the plate or exit electrode 5 especially since the ion beam is not defocused (unlike the arrangement described above with reference to FIG. 2). The detrimental effects due to surface charging of the plate or exit electrode 5 can therefore be particularly problematic with this particular arrangement and mode of operation.

As will be appreciated, one of the problems with the conventional ways of operating an electrostatic lens arrangement in order to attenuate an ion beam is that a significant proportion of the ion beam will impinge upon the plate or exit electrode 5 in such a way that surface charging effects can occur in a region adjacent to an opening or aperture in the plate or exit electrode 5. This can adversely affect the subsequent performance of the electrostatic lens arrangement especially when the lens is then switched to operate in a high transmission mode of operation.

Figure 4:
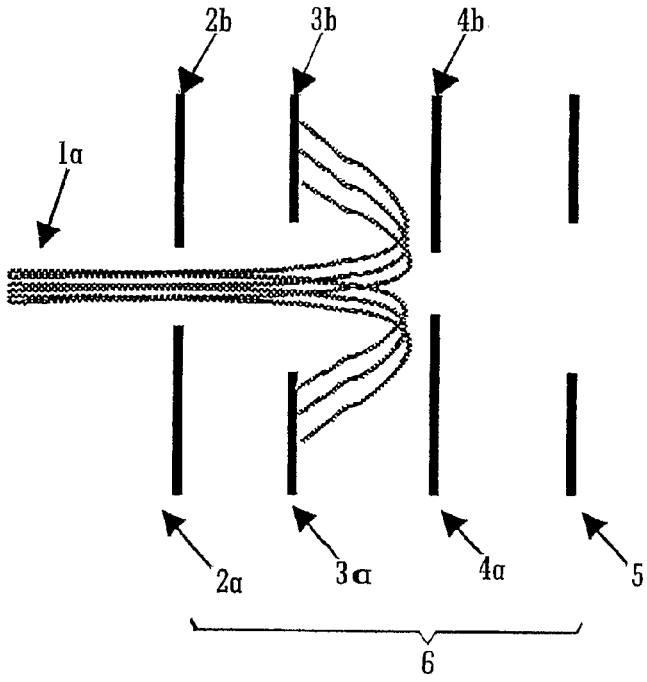
FIG. 4 shows a zero transmission mode of operation according to an embodiment of the present invention wherein a retarding voltage is applied to an electrode of an ion gate or ion beam attenuator.

A preferred embodiment of the present invention will now be described with reference to FIG. 4. The preferred embodiment addresses at least some, preferably all of the limitations of the known arrangements and conventional modes of operation. A beam of positive ions 1*a* is shown in FIG. 4 traversing an electrostatic lens assembly arranged and operated according to a preferred embodiment. The preferred electrostatic lens or electrostatic lens assembly 6 comprises a first pair of electrodes 2*a*,2*b*, a second pair of electrodes 3*a*,3*b*, a third pair of electrodes 4*a*,4*b* and a plate or exit electrode 5. The plate or exit electrode 5 may preferably form a differential pumping aperture or differential pumping aperture electrode, preferably having a 2.0-2.5 mm diameter substantially circular aperture. The differential pumping aperture electrode 5 preferably forms a differential pumping aperture between two vacuum chambers. Downstream of the plate or differential pumping aperture or electrode 5 are preferably provided one or more gas collision cells and/or one or more relatively high pressure ion guides.

The second pair of electrodes 3*a*,3*b* of the electrostatic lens 6 is preferably arranged to have a radial separation which is preferably substantially greater than the radial separation between the first and third pairs of electrodes 2*a*,2*b*,4*a*,4*b* and which may or may not be comparable to the diameter of the aperture in the plate or exit electrode 5.

Still with reference to FIG. 4, at a first time T1 a retarding voltage is preferably applied to the third pair of electrodes 4*a*,4*b*. The retarding voltage preferably causes the entire ion beam to be reflected or retarded in such a way that the ions are preferably accelerated in an opposite direction to their initial direction of travel. The reflected ions are preferably arranged to fall incident upon the rear surface of the second pair of electrodes 3*a*,3*b* which are preferably spaced away from the central axis. In this mode of operation the ion beam transmission through the plate or exit electrode 5 is preferably zero or substantially zero.

Figure 5:
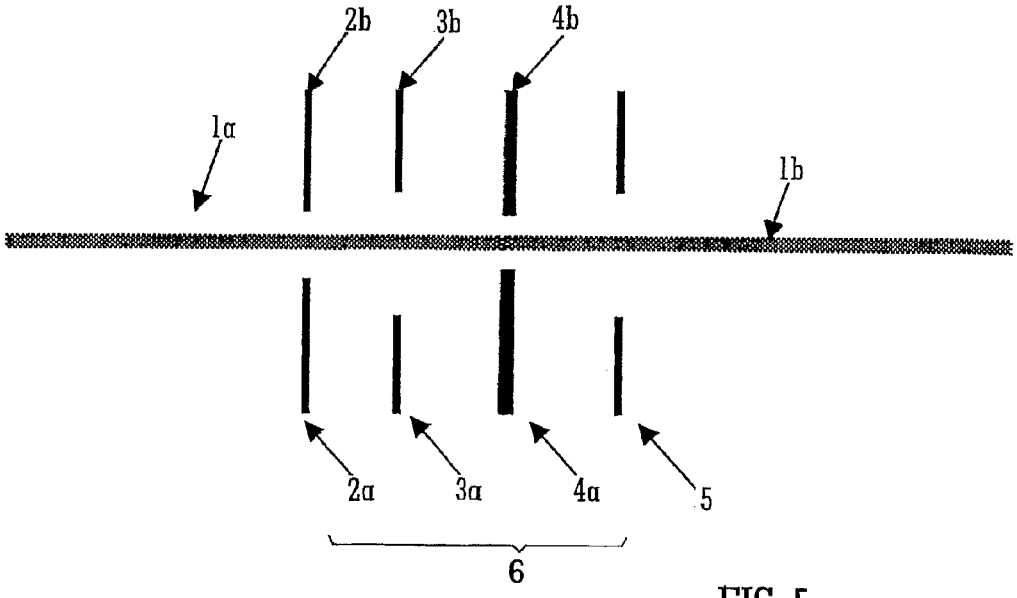
FIG. 5 shows a high transmission mode of operation according to an embodiment of the present invention wherein no retarding voltage is applied to an electrode of an ion gate or ion beam attenuator.

FIG. 5 shows a high transmission mode of operation according to a preferred embodiment wherein at a second later time T2 the retarding voltage applied to the third pair of electrodes 4*a*,4*b* is preferably switched OFF. Accordingly, in this mode of operation the first pair of electrodes 2*a*,2*b*, the second pair of electrodes 3*a*,3*b* and the third pair of electrodes 4*a*,4*b* are all preferably held at substantially the same potential such that the ion beam is now preferably fully transmitted through the plate or exit electrode 5.

According to the preferred embodiment the ion gate or ion beam attenuator 6 (e.g. electrostatic lens arrangement or less preferably other form of ion gate or ion beam attenuator) is preferably repeatedly switched back and forth between at least the low (or zero) transmission mode of operation and the relatively high (or full) transmission mode of operation. According to less preferred embodiments the ion gate or ion beam attenuator 6 may be switched to one or more further or intermediate modes of operation i.e. the ion gate or ion beam attenuator 6 does not necessarily have to be directly switched back and forth between 0% and 100% transmission modes of operation.

The degree of attenuation of the ion beam according to the preferred embodiment preferably depends upon the relative amount of time that the ion gate or ion beam attenuator 6 is maintained in the high and low transmission modes of operation.

Figure 6:
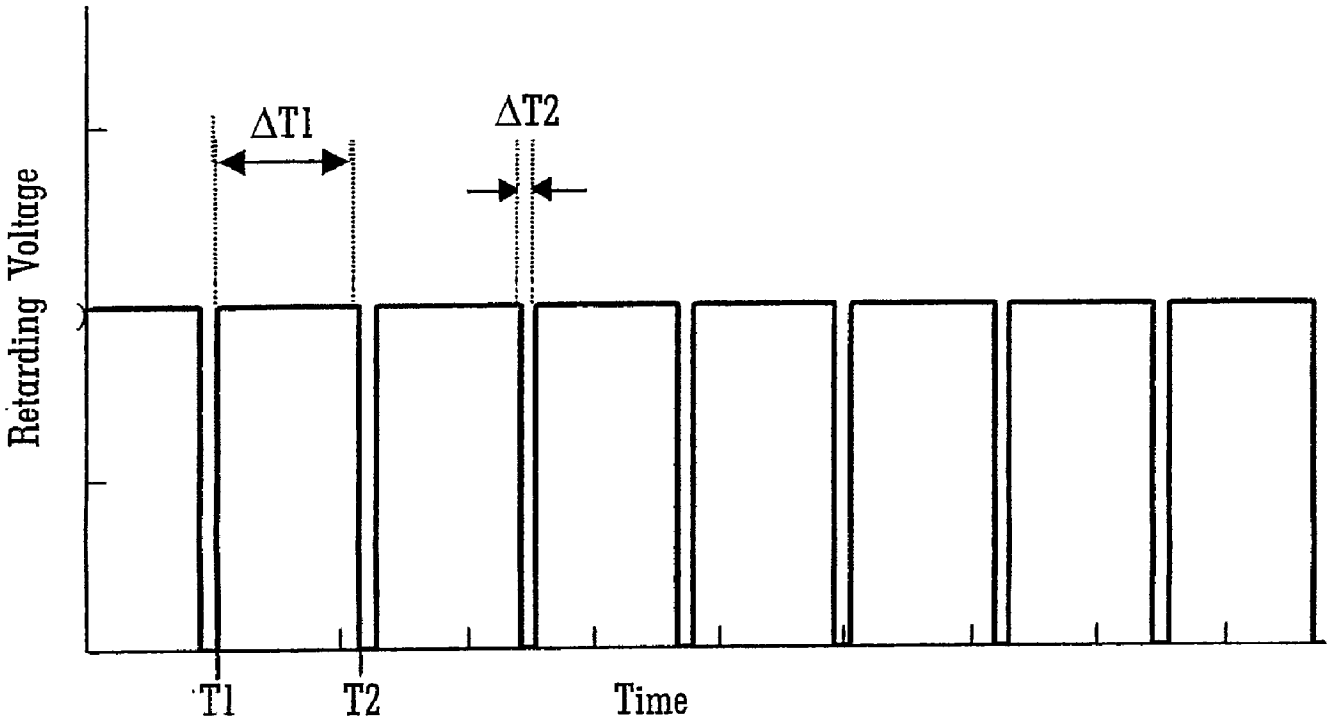
FIG. 6 shows a voltage timing diagram illustrating the period of time ΔT1 during which a retarding voltage is applied to an electrode of an ion gate or ion beam attenuator according to a preferred embodiment.

FIG. 6 shows a voltage timing diagram according to a preferred embodiment wherein a gate or retarding voltage is preferably applied to the third pair of electrodes 4*a*,4*b*. The gate or retarding voltage may be considered to be otherwise switched ON starting at a time T1 and lasting for or otherwise being applied to the third pair of electrodes for a time period ΔT1. During this time period ΔT1, the transmission of the ion beam through the aperture in the plate or exit electrode 5 is preferably substantially zero i.e. preferably substantially all ions are reflected back away from the third pair of electrodes 4*a*,4*b* towards the rear surface of the second pair of electrodes 3*a*,3*b* whereupon they impinge. Accordingly, preferably no ions exit the ion gate or ion beam attenuator 6 in this mode of operation.

At the end of the time period ΔT1 the gate or retarding voltage applied to the third pair electrodes 4*a*,4*b* is then preferably switched OFF. The gate or retarding voltage then preferably remains OFF for a further time period ΔT2 which is preferably substantially shorter than the time period ΔT1. During the time period ΔT2 during which the ion gate or ion beam attenuator 6 is switched OFF (or the retarding voltage remains switched OFF), the transmission of an ion beam through the aperture in the plate or exit electrode 5 preferably remains high and is preferably substantially 100%.

The cycle of switching a gate or retarding voltage ON for a time period ΔT1 and then switching the gate or retarding voltage OFF for a subsequent time period ΔT2 is preferably repeated multiple times. According to the preferred embodiment this may be repeated in a substantially regular manner as illustrated in FIG. 6. However, as previously mentioned, according to less preferred embodiments the ion gate or ion beam attenuator 6 may be repeatedly switched between three or more different modes of operation.

The ion gate or ion beam attenuator 6 is preferably switched at a rate which is preferably at least 50-100 times faster than the spectrum acquisition rate of a mass analyser arranged downstream of the ion gate or ion beam attenuator 6 and which is preferably used to mass analyse the ion beam.

This will be discussed in more detail below. According to less preferred embodiments the ion gate or ion beam attenuator 6 may be switched between modes in a irregular, variable or random manner.

The ion gate or ion beam attenuator 6 as operated according to the preferred embodiment may be considered to comprise a pulsed transmission ion gate or ion beam attenuator 6 having a mark space ratio given by:

$$\Delta T2/\Delta T1$$

wherein ΔT2 is the time period during which the ion transmission is substantially 100% (i.e. the ion gate or ion beam attenuator 6 is switched OFF) and ΔT1 is the time period during which the ion transmission is substantially 0% (i.e. the ion gate or ion beam attenuator 6 is switched ON).

The average relative transmission of the ion beam is preferably proportional to the duty cycle of the ion gate or ion beam attenuator 6 which is preferably given by:

$$\Delta T2/(\Delta T1+\Delta T2)$$

In the particular voltage timing diagram shown in FIG. 6 the mark space ratio ΔT2/ΔT1 is 1:9 and hence the duty cycle is 0.1. Therefore, the ion beam will be attenuated by 90% i.e. the ion beam 1*b* exiting the ion gate or ion beam attenuator 6 is preferably only 10% of the intensity of the ion beam 1*a* received by or incident upon the ion gate or ion beam attenuator 6.

Figure 7:
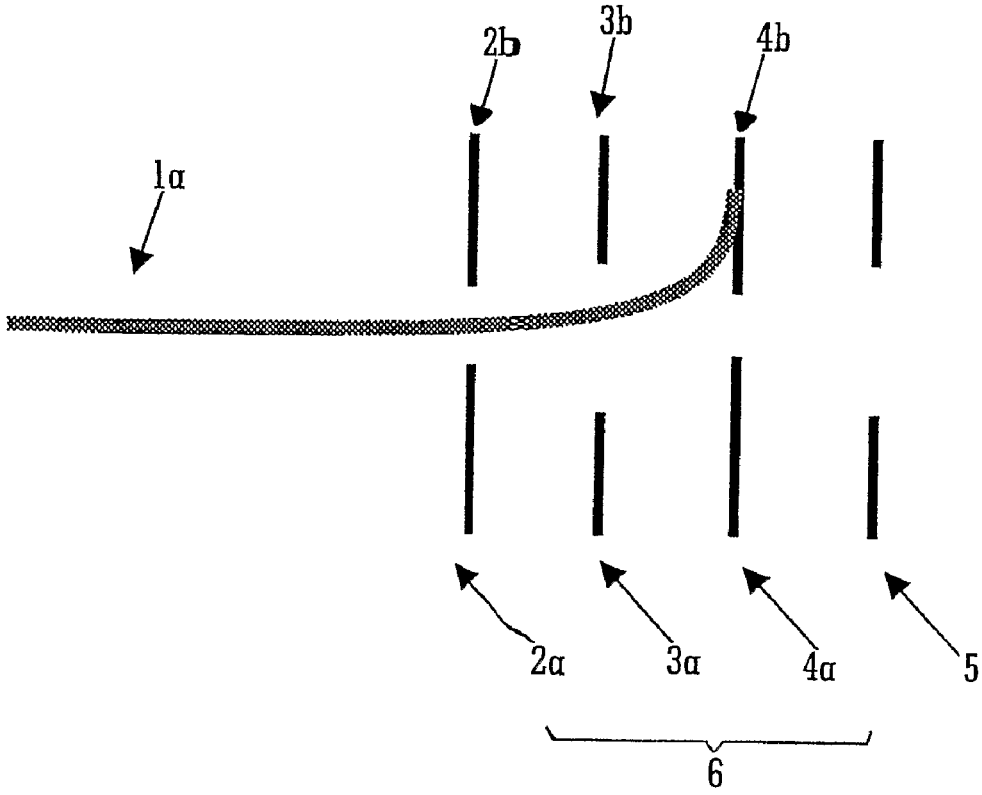
FIG. 7 shows an alternative zero transmission mode of operation according to an embodiment of the present invention wherein a deflecting voltage is applied to an electrode of an ion gate or ion beam attenuator.

FIG. 7 shows an alternative low transmission mode of operation wherein the ion beam is deflected (rather than reflected backwards) in the zero transmission mode of operation by the application of a raised positive voltage to one of the pair of second electrodes 3*a*. The ion gate or ion beam attenuator 6 according to this embodiment may therefore be considered to comprise a pulsed transmission ion gate or ion beam attenuator 6 having a deflection electrode 3*a*. During the time period ΔT1 of zero ion transmission, a deflection voltage is preferably applied to the deflection electrode 3*a* such that the ion beam 1*a* passing through the ion gate or ion beam attenuator 6 is preferably deflected and falls incident upon the front surface of one of the third pair of electrodes 4*b*. As a result, the ion transmission through the plate or exit electrode 5 is preferably substantially zero. The ion gate or ion beam attenuator 6 is then preferably switched to a high transmission mode of operation wherein the deflection voltage applied to one of the pair of second electrodes 3*a* is preferably turned OFF (or is substantially reduced) for a time period ΔT2. Accordingly, the transmission of the ion beam through the plate or exit electrode 5 is correspondingly high in this mode of operation. The time period ΔT2 is preferably shorter than the time period ΔT1.

The ion beam 1*b* which preferably emerges from the preferred ion gate or ion beam attenuator 6 preferably has an overall or average intensity which is preferably substantially lower than the intensity of the ion beam 1*a* received by the ion gate or ion beam attenuator 6 i.e. the number of ions emerging from or exiting the ion gate or ion beam attenuator 6 per unit time (i.e. ion flux) is preferably reduced.

In a preferred embodiment the total cycle time (i.e. the sum of the time period ΔT1 spent in the low or zero transmission mode of operation and the time period ΔT2 spent in the high transmission mode) of the ion gate or ion beam attenuator 6 is preferably of the order of 100-1000 μs. However, according to less preferred embodiments the total cycle time may be shorter or longer than this.

According to the preferred embodiment the degree of attenuation of an ion beam by the preferred ion gate or ion beam attenuator 6 is preferably controlled by controlling the duty cycle of the ion gate or ion beam attenuator 6. For example, in order to increase (or reduce) the degree or amount of attenuation of the ion beam, the mark space ratio or duty cycle may be altered or varied such that the time period ΔT1 spent in the low or zero transmission mode of operation is preferably relatively increased (or reduced) compared to the time period ΔT2 spent in the high transmission mode of operation.

According to an embodiment, one or more ion guides and/or one or more gas collision cells may be arranged upstream and/or downstream of the preferred ion gate or ion beam attenuator 6. Preferably, at least one ion guide or gas collision cell is arranged downstream of the ion gate or ion beam attenuator 6 and is preferably arranged to be maintained, in use, at a relatively high pressure (e.g. $>10^{-3}$ mbar). The relatively high pressure ion guide or gas collision cell is preferably arranged so as to effectively decouple the ion gate or ion beam attenuator 6 from other parts of the mass spectrometer. The relatively high pressure ion guide or gas collision cell preferably smoothes or otherwise converts the pulses of ions emitted from the ion gate or ion beam attenuator 6 into a substantially continuous beam of ions. The relatively high pressure ion guide or gas collision cell therefore preferably improves the operation of the mass spectrometer when the ion gate or ion beam attenuator 6 is used in conjunction with a discontinuous mass analyser such as an orthogonal acceleration Time of Flight (TOF) mass analyser. Other embodiments are contemplated wherein other devices may be provided in order to convert the pulses of ions emitted from the preferred ion gate or ion beam attenuator 6 into a substantially continuous or pseudo-continuous ion beam.

The ion guide or gas collision cell arranged downstream of the ion gate or ion beam attenuator 6 may comprise an AC or RF multipole rod set, a segmented RF or AC multipole rod set, an AC or RF stacked ring ion tunnel ion guide or an AC or RF stacked ring ion funnel ion guide. The ion guide or gas collision cell may optionally utilise a linear acceleration field i.e. a constant DC voltage gradient may be maintained along at least a portion of the length of the ion guide or gas collision cell. A travelling DC voltage or potential (or voltage or potential waveform) may additionally/alternatively be applied to the electrodes of the ion guide or gas collision cell in order to propel at least some ions through or along at least a portion of the ion guide or gas collision cell. The application of a travelling DC voltage or potential preferably involves applying one or more time varying or transient DC potentials or DC potential waveforms to at least a portion of the one or more ion guides or gas collision cells in order to urge ions along at least a portion of the one or more ion guides or gas collision cells. This approach may also be used to ensure that ions are resident in the one or more ion guides or gas collision cells for a total time applicable to the particular mode of operation of the pulsed ion gate.

Advantageously, an ion beam can preferably be attenuated by a precisely controlled amount using the preferred ion gate or ion beam attenuator 6 without affecting the mass resolution, mass calibration or mass accuracy of, for example, an orthogonal acceleration Time of Flight mass analyser or other form of mass analyser arranged downstream of the preferred ion gate or ion beam attenuator 6 and optional ion guide or gas collision cell.

According to the preferred embodiment the ion beam transmitted by the preferred ion gate or ion beam attenuator 6 and which may optionally pass through a relatively high pressure ion guide or gas collision cell is preferably mass analysed. Mass spectra, mass spectral data or mass data are preferably acquired, histogrammed, accumulated, recorded or output on a slower, preferably substantially slower, timescale than the speed of switching the ion gate or ion beam attenuator 6 between modes. For example, with a conventional arrangement the electrostatic lens is switched to a low transmission mode of operation and then the ion beam is mass analysed and a mass spectrum is acquired. The electrostatic lens is then switched to a high transmission mode of operation and the ion beam is then again mass analysed and a further mass spectrum is acquired. Accordingly, with a conventional arrangement the mass analyser acquires, samples or mass analyses an ion beam at the same rate and in a substantially synchronous manner to the switching of the electrostatic lens. In contrast, according to the preferred embodiment it is the repeated switching between modes of the ion gate or ion beam attenuator 6 which reduces the overall intensity of the ion beam. The switching between modes is preferably substantially faster and asynchronous when compared with the spectrum acquisition rate of the mass analyser. For example, according to an embodiment the ion gate or ion beam attenuator 6 may be switched, for example, at least 50-100 times between different modes to reduce the intensity of the ion beam before the ion beam during which time a single mass spectrum is acquired, histogrammed or accumulated. The spectrum acquisition rate of the mass analyser is therefore preferably much slower than the speed of switching the ion gate or ion beam attenuator 6 between modes. Furthermore, the spectrum acquisition rate of the mass analyser is preferably essentially asynchronous to and decoupled from the switching of the ion gate or ion beam attenuator 6.

A particularly preferred embodiment is contemplated wherein either an Electrospray or MALDI ion source is provided with an ion guide provided downstream thereof. The ion guide is preferably followed by a first mass filter which preferably comprises a quadrupole rod set mass filter. An ion gate or ion beam attenuator 6 according to a preferred embodiment is preferably arranged downstream of the first mass filter. A gas collision cell or relatively high pressure ion guide is preferably arranged downstream of the ion gate or ion beam attenuator 6. A Time of Flight mass analyser or other form of mass analyser is preferably arranged downstream of the relatively high pressure ion guide or gas collision cell. The particularly preferred embodiment allows MS and MS-MS experiments to be performed.

Figure 8:
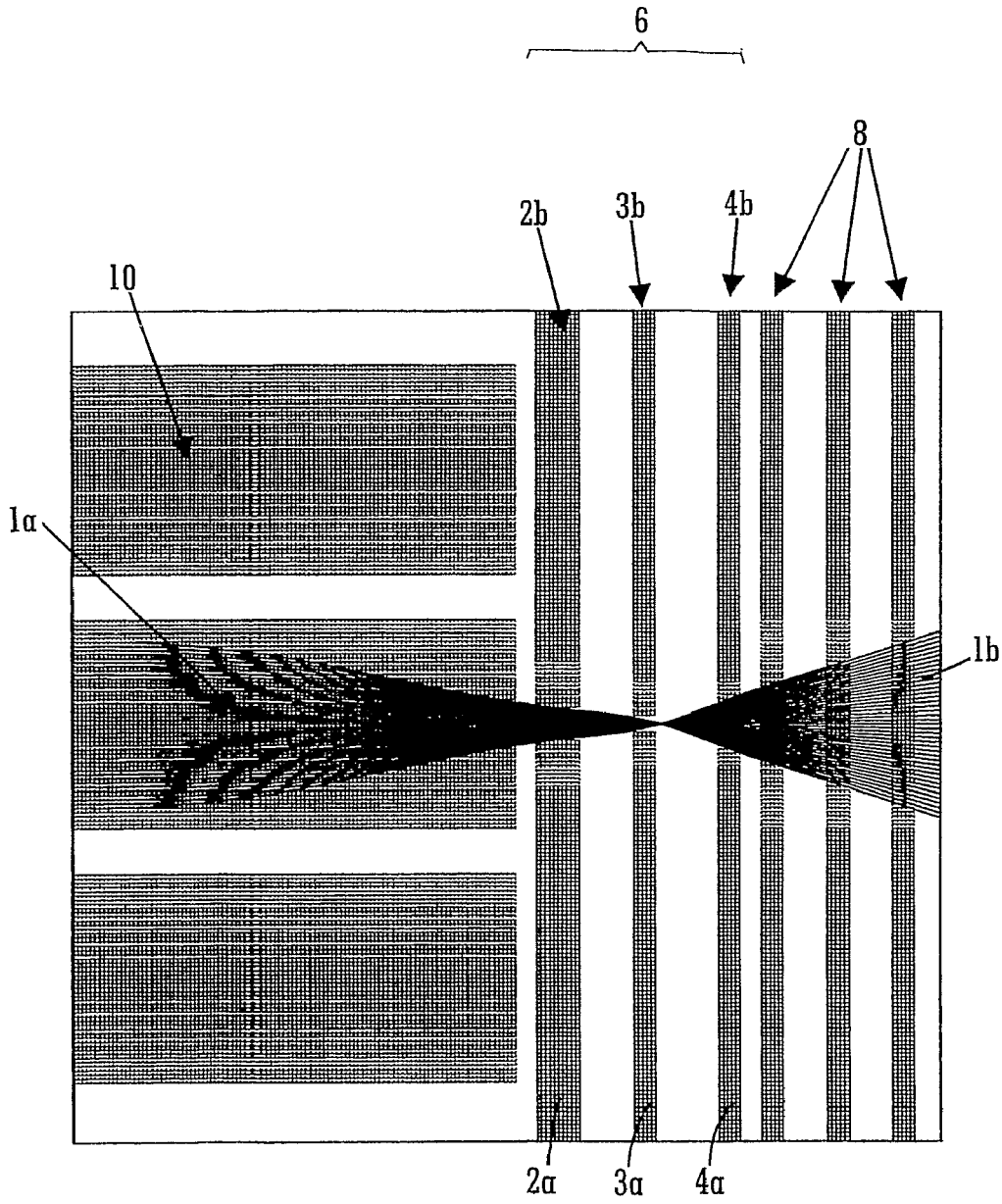
FIG. 8 shows a SIMION® model of a preferred ion gate or ion beam attenuator in a high transmission mode of operation.

FIG. 8 shows a SIMION® model of an ion gate or ion beam attenuator 6 according to a preferred embodiment in a relatively high transmission mode of operation. In this mode of operation the ion gate or ion beam attenuator 6 is arranged to transmit ions preferably with an efficiency of 100%. FIG. 8 shows the path taken by a beam of positive ions 1*a* having an axial energy of 3 eV and exiting an RF-only hexapole ion guide 10 maintained at a relatively low pressure and arranged upstream of the preferred ion gate or ion beam attenuator 6. The hexapole ion guide 10 is preferably maintained at a relative potential of 0V. The first pair of electrodes 2*a*,2*b* of the preferred ion gate or ion beam attenuator 6 are preferably held at a relative potential of −57 V. The second pair of electrodes 3*a*,3*b* are preferably held at a relative potential of −2V. The third pair of electrodes 4*a*,4*b* are preferably held at a relative potential of −1 V. A relatively high pressure ion guide or gas collision cell 8 is modelled as being provided downstream of the ion gate or ion beam attenuator 6 and which receives ions emitted from the preferred ion gate or ion beam attenuator 6.

The relatively high pressure ion guide or gas collision cell 8 is modelled as being held at a relative potential of −2 V. As can be seen from FIG. 8, ions are preferably focussed by the preferred ion gate or ion beam attenuator 6 to a point just beyond or downstream of the second pair of electrodes 3*a*,3*b* and at a location between the second pair of electrodes 3*a*,3*b* and the third pair of electrodes 4*a*,4*b*. The ions are shown then being onwardly transmitted to an ion guide or collision cell 8 with a preferably high (e.g. 100%) transmission.

Figure 9:
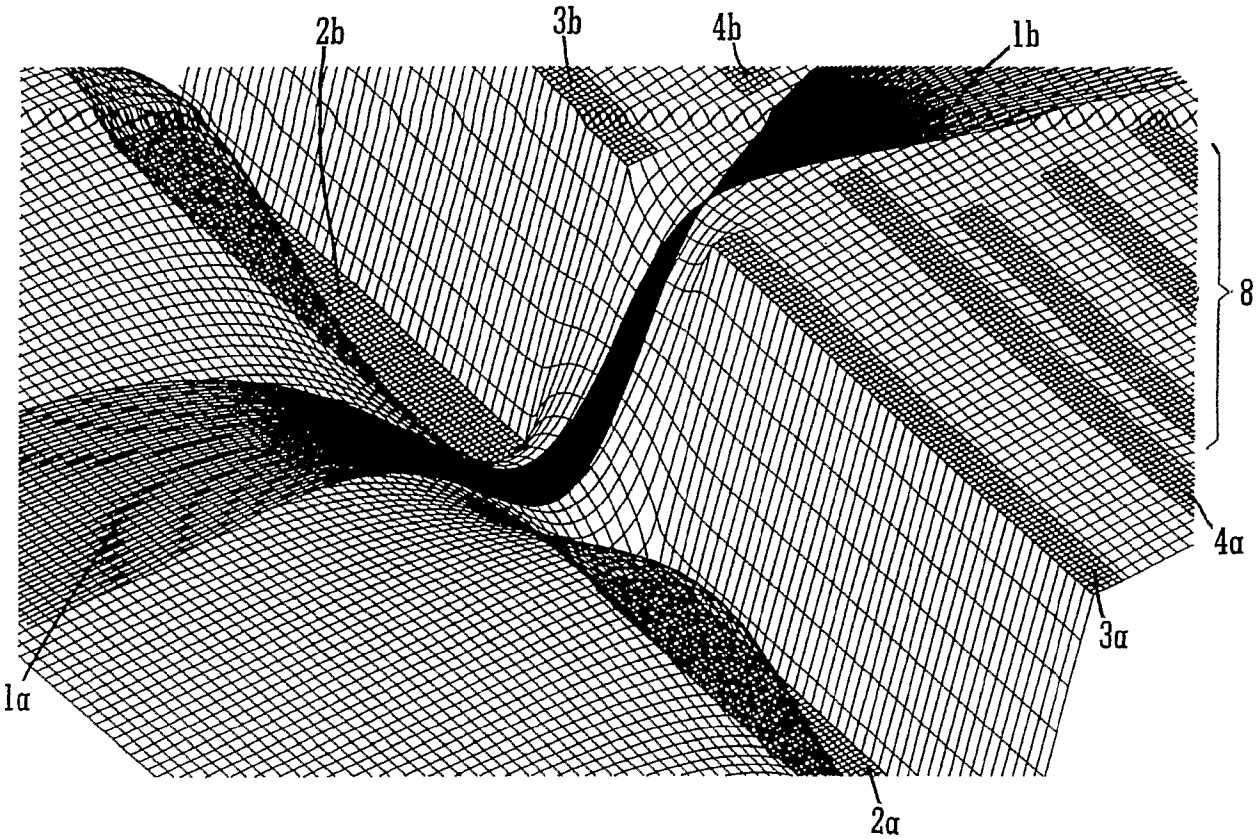
FIG. 9 shows a 3D potential energy diagram of the potentials within a preferred ion gate or ion beam attenuator in the high transmission mode of operation as shown in FIG. 8.

FIG. 9 shows a three-dimensional potential energy diagram showing the potential energy profile within the preferred ion gate or ion beam attenuator 6 wherein the ion gate or ion beam attenuator 6 is preferably maintained in a relatively high transmission mode of operation as described above in relation to FIG. 8.

Figure 10:
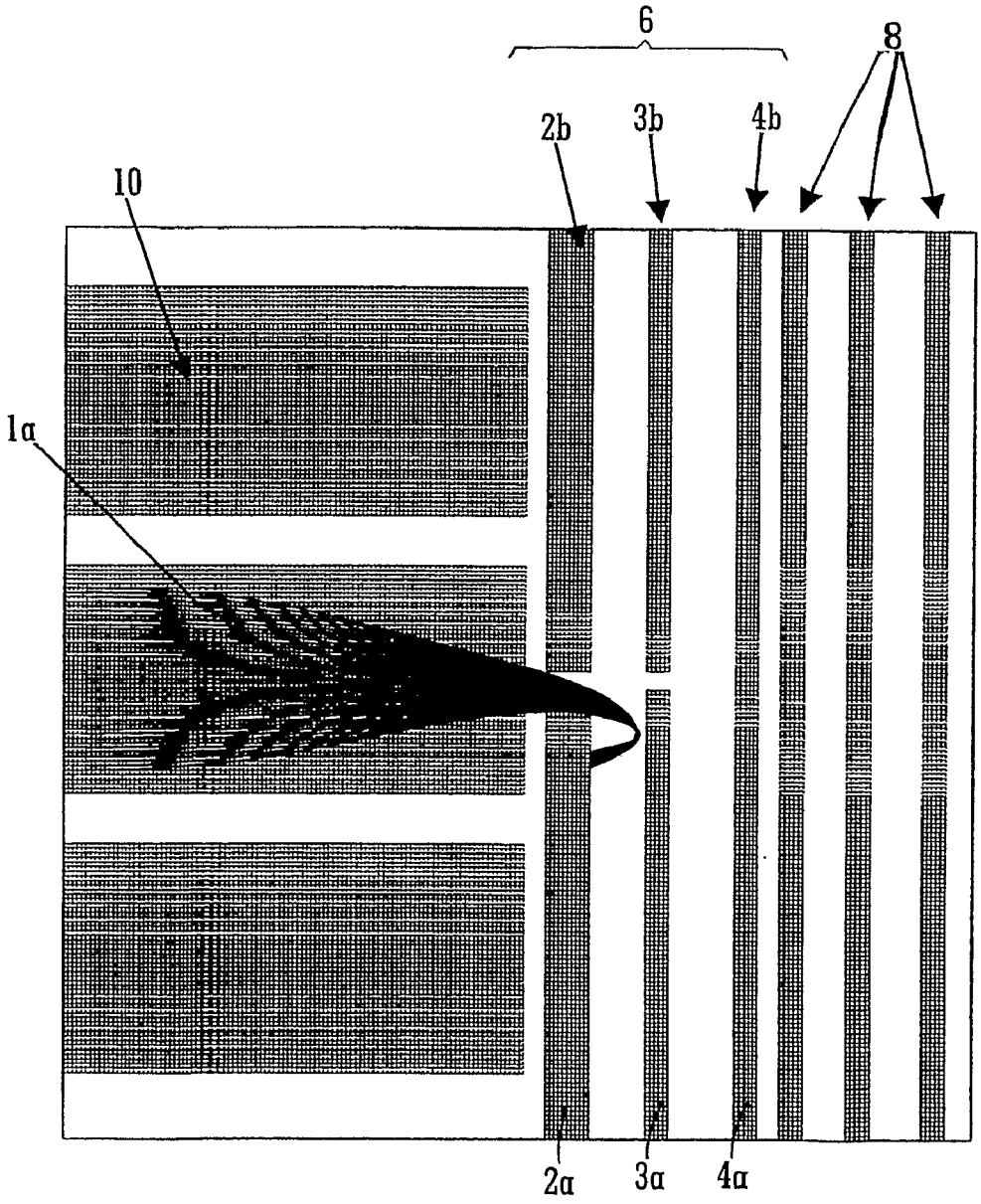
FIG. 10 shows a SIMION® model of a preferred ion gate or ion beam attenuator in a zero transmission mode of operation.

FIG. 10 shows a SIMION® model of an ion gate or ion beam attenuator 6 according to a preferred embodiment in a relatively low or zero transmission mode of operation. In this mode off operation the ion gate or ion beam attenuator 6 is preferably arranged to substantially attenuate ions, preferably such that no ions preferably exit the ion gate or ion beam attenuator 6 in this mode of operation. FIG. 10 shows the ion path taken by a beam of positive ions 1*a* having an axial energy of 3 eV and which exit an RF-only hexapole ion guide 10 maintained at a relatively low pressure. The RF-only hexapole ion guide 10 is preferably maintained at a relative potential of 0 V. One of the first pair of electrodes 2*a* is preferably held at a relative potential of −47 V and the other of the first pair of electrodes 2*b* is preferably held at a relative potential of −67 V. The second pair of electrodes 3*a*,3*b* are both preferably held at a relative potential of +8 V. The third pair of electrodes 4*a*,4*b* are preferably both held at a relative potential of −1 V. As with the embodiment shown and described above in relation to FIGS. 8 and 9, a relatively high pressure ion guide or gas collision cell 8 is modelled as being provided downstream of the ion gate or ion beam attenuator 6 and is maintained at a relative potential of −2 V. Ions are preferably accelerated by the first pair of electrodes 2*a*,2*b* but are also preferably deflected off axis by the different potentials at which the first pair of electrodes 2*a*,2*b* are preferably maintained. The ions are also retarded by the application of relatively high potentials to the second pair of electrodes 3*a*,3*b*. Ions are therefore retarded by the electric field maintained between the first pair of electrodes 2*a*,2*b* and the second pair of electrodes 3*a*,3*b* and as a result are reaccelerated back towards the rear surface of one of the first pair of electrodes 2*a*. Preferably, none of the ions pass beyond the second pair of electrodes 3*a*,3*b*. Accordingly, preferably no ions exit the ion gate or ion beam attenuator 6 in this mode of operation. The ion transmission through the ion gate or ion beam attenuator 6 is therefore preferably substantially zero in this mode of operation.

Figure 11:
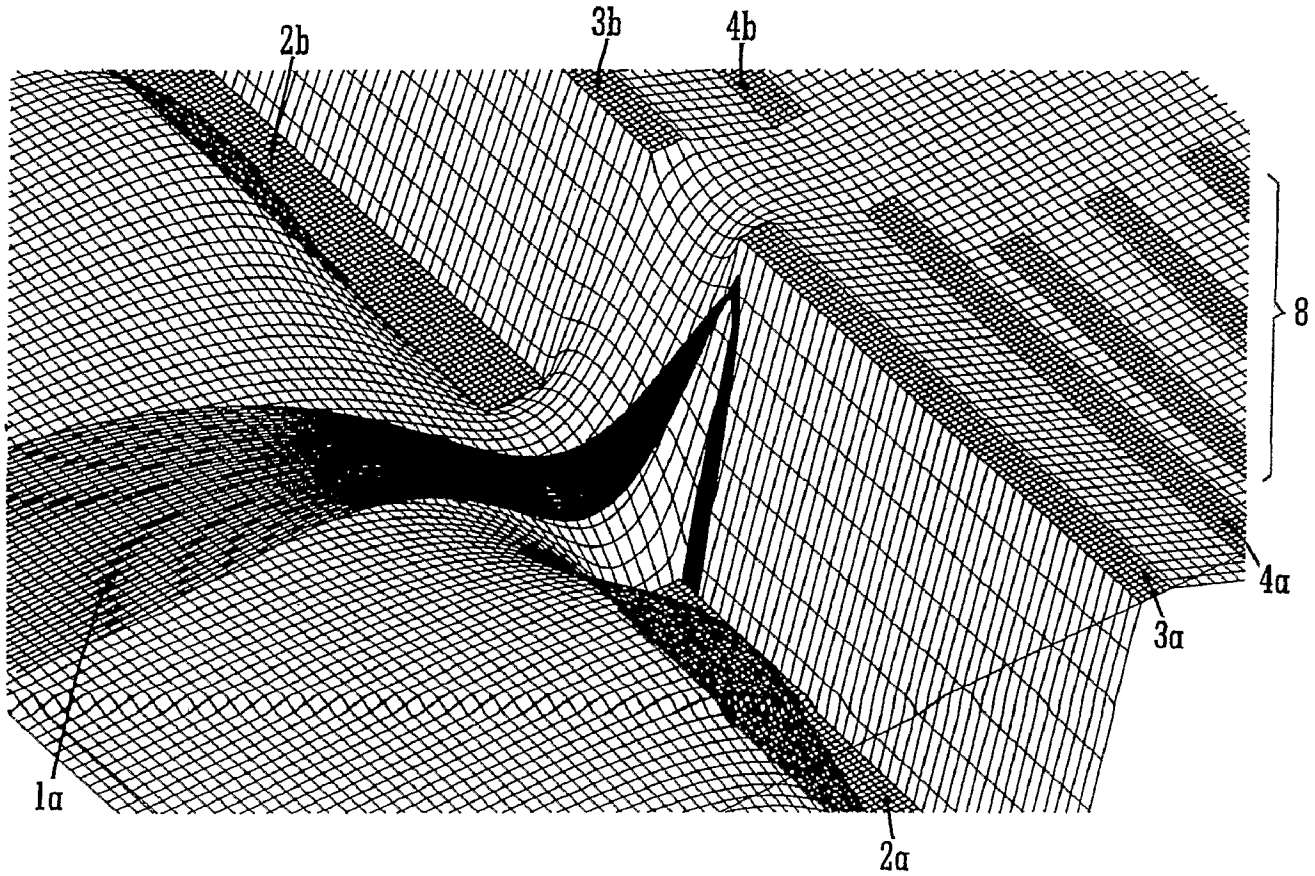
FIG. 11 shows a 3D potential energy diagram of the potentials within a preferred ion gate or ion beam attenuator in the zero transmission mode of operation as shown in FIG. 10.

FIG. 11 shows a three-dimensional potential energy diagram showing the potential energy profile within the ion gate or ion beam attenuator 6 when the ion gate or ion beam attenuator 6 is maintained in the low (zero) transmission mode as described above in relation to FIG. 10.

Figure 12:
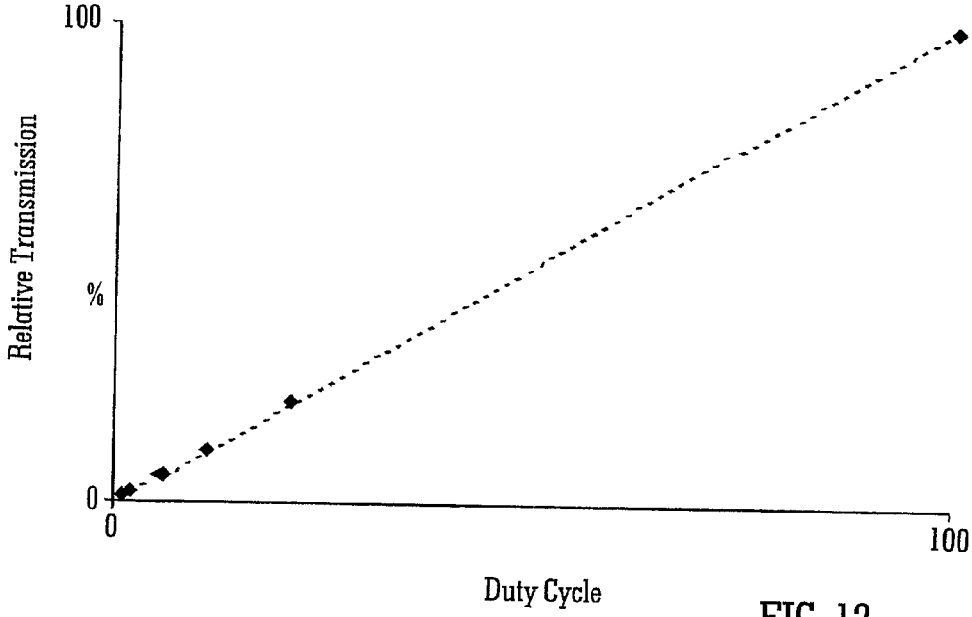
FIG. 12 shows an experimentally determined relationship between the relative transmission of an ion gate or ion beam attenuator according to a preferred embodiment versus the duty cycle of the ion gate or ion beam attenuator.
Figure 13:
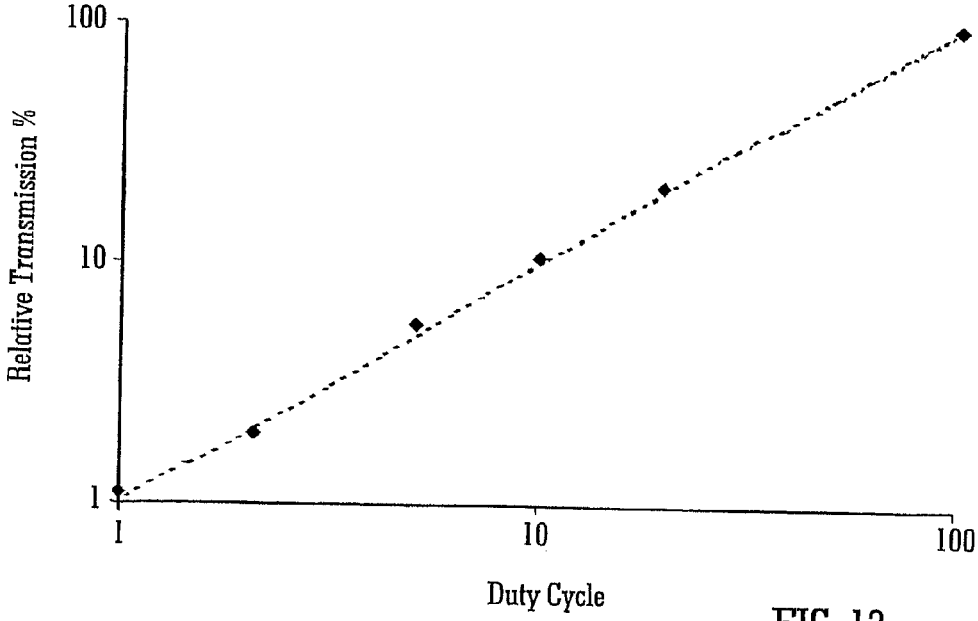
FIG. 13 shows the same data as shown in FIG. 12 but plotted on a log-log scale for sake of clarity.

FIG. 12 shows an experimentally determined relationship between the observed relative transmission of an ion beam through the preferred ion gate or ion beam attenuator 6 and the duty cycle of the ion gate or ion beam attenuator 6 according to the preferred embodiment. It can be seen that there is a direct and predictable linear relationship between the relative transmission of the ion gate or ion beam attenuator 6 and the duty cycle of the ion gate or ion beam attenuator 6. For clarity the same data shown in FIG. 12 has been re-plotted in FIG. 13 as log of the relative transmission versus log of the duty cycle of the ion gate or ion beam attenuator 6. The cycle time for the particular experiment, the results of which are shown in FIGS. 12 and 13, was fixed at 300 μs.

FIG. 14A shows a mass spectrum obtained using a mass spectrometer comprising an Electrospray Ionisation ion source, a mass filter and an ion gate or ion beam attenuator 6. MS-MS analysis was performed using an orthogonal acceleration Time of Flight mass spectrometer. The mass spectrum shown in FIG. 14A was obtained by infusing (Glu)-fibrinopeptide-B (having a mass to charge ratio of 785.8) into the ion source. The mass spectrum was acquired when the ion gate or ion beam attenuator 6 was constantly operated at full 100% transmission. Ten mass spectra were obtained, each over a period of 1.2 s. The ten mass spectra were then averaged to produce the mass spectrum shown in FIG. 14A.

FIG. 14B shows a mass spectrum obtained when the same apparatus was used except that the ion beam was attenuated by 90% using an ion gate or ion beam attenuator 6 operated according to the preferred embodiment. The ion gate or ion beam attenuator 6 was pulsed with a duty cycle of 0.1 and a total cycle time of 300 μs. 100 mass spectra were obtained, each over a period of 1.2 s. The 100 mass spectra were then averaged to produce the mass spectrum shown in FIG. 14B.

It can be seen from comparing FIGS. 14A and 14B that the amount of attenuation is constant for peaks over the entire mass range shown i.e. the ion gate or ion beam attenuator 6 advantageously attenuates the ion beam independently of the mass to charge ratio of the ions present in the ion beam. The precise measured attenuation factor based upon the intensity of the most intense peak having a mass to charge ratio of 684.35 was determined to be 89.9%.

FIG. 15A shows in greater detail the mass spectrum shown in FIG. 14A across the narrower mass to charge ratio range of 1171 to 1175. Similarly, FIG. 15B shows in greater detail the mass spectrum shown in FIG. 14B across the narrower mass to charge ratio range of 1171 to 1175. No effect on peak resolution peak shape or mass to charge ratio is evident due to the action of the preferred ion gate or ion beam attenuator 6.

An ion gate or ion beam attenuator 6 according to the preferred embodiment may be used, for example, to provide controlled attenuation of a continuous ion beam which is subsequently mass analysed by an orthogonal acceleration Time of Flight mass analyser or another type of mass analyser such as an axial acceleration Time of Flight mass analyser, a Paul or 3D quadrupole ion trap mass analyser, a 2D or linear quadrupole ion trap mass analyser, a Fourier Transform Ion Cyclotron Resonance ("FTICR") mass analyser, a magnetic sector mass analyser or a quadrupole mass analyser.

Embodiments are contemplated wherein an ion beam passing through the ion gate or ion beam attenuator 6 according to the preferred embodiment are subjected to MS, MSMS or $MS^n$ analysis.

The preferred ion gate or ion beam attenuator 6 may also be used, for example, to provide controlled attenuation of an ion beam emitted from an ion source such as, for example, an Electrospray Ionisation ion source, an APPI ion source, an APCI ion source, a Matrix Assisted Laser Desorption Ionisation ion source, a LDI ion source, an APMALDI ion source, a DIOS ion source, an Electron Impact ion source, a CI ion source, a FI ion source, a FD ion source, an ICP ion source, a FAB ion source or a LSIMS ion source.

According to an embodiment of the present invention the attenuation factor of the preferred ion gate or ion beam attenuator 6 may be automatically and precisely controlled during mass analysis. For example, a measurement of the ion current may be made at regular intervals during an analysis step. The amount of attenuation required may then be repeatedly calculated from this measurement as the analysis proceeds. The measurement of ion current may be made, for example, by examination of the mass spectral data recorded as the analysis proceeds. The total ion current recorded or the ion current at one or more selected mass to charge ratios may then be used to determine the attenuation factor of the ion gate or ion beam attenuator 6 for the next mass spectrum to be recorded.

According to another embodiment, during the period of time that the preferred ion gate or ion beam attenuator 6 is operated in a zero transmission mode of operation, ions may be directed towards a separate ion detector preferably arranged close to the preferred ion gate or ion beam attenuator 6. The signal recorded using this ion detector may then be used to calculate the total ion current at the preferred ion gate or ion beam attenuator 6 based on the duty cycle. This measurement may then be used to calculate a new duty cycle for the ion gate or ion beam attenuator 6 if the 3D ion current exceeds the allowable level which can be accommodated by the mass analyser or ion detector employed. For example, this method provides a way of automatically reducing the number of ions per unit time which enter an ion trap mass analyser based upon the known maximum number of ions which can be permitted.

According to other less preferred embodiments the ion beam may be rapidly pulsed between zero (or low) transmission and a relatively high transmission using other electrostatic, magnetic or mechanical arrangements. For example, according to a less preferred embodiment a mechanical shutter may be used as an ion gate or ion beam attenuator in place of an electrostatic lens or electrostatic arrangement.

According to a less preferred embodiment the transmission does not necessarily have to be reduced to zero during the low transmission mode. Instead, for example, it is contemplated that the transmission may be reduced to a transmission >0%. However, if the ion transmission in the low transmission mode of operation is not reduced to 0% then there is a risk of surface charging effects occurring which may cause instability in the attenuation factor by which the ion beam is attenuated. It is for this reason that a 0% transmission in the low transmission mode is particularly preferred.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising:

attenuating a beam of ions by repeatedly switching an ion beam attenuator between a first mode of operation and a second mode of operation at a first frequency; and mass analysing or acquiring, histogramming, accumulating, recording or outputting mass spectra, mass spectral data or mass data at or with a second frequency, wherein said first frequency is greater than said second frequency.

2. A method of mass spectrometry comprising:

providing an ion beam attenuator;

providing an ion guide or gas collision cell downstream of said ion beam attenuator to convert a non-continuous beam of ions into a substantially continuous beam of ions;

providing a mass analyser arranged downstream of said ion guide or gas collision cell; and switching said ion beam attenuator between a first mode of operation and a second mode of operation at least 10, 20, 30, 40, 50, 60, 70, 80, 90 or 100 times faster than said mass analyser mass analyses or acquires, histograms, accumulates, records or outputs mass spectra, mass spectral data or mass data.

3. A mass spectrometer comprising:

attenuating means for attenuating an ion beam by cyclically closing and opening the means for attenuating to output a pulsed non-continuous beam of ions characterized by a mark space ratio, wherein a closed low-transmission mode of operation blocks the ion beam from exiting the attenuating means, and an open high-transmission mode of operation allows ions to pass through and exit the attenuating means; and switching means for switching between a first attenuation mode of operation wherein said ion beam is attenuated by a first factor associated with a first mark space ratio and a second attenuation mode of operation wherein said ion beam is attenuated by a second different factor associated with a second different mark space ratio, wherein in said closed low-transmission mode of operation the ion transmission is substantially 0% and in said open high-transmission mode of operation the ion transmission is >0%, and wherein the first and second attenuation modes provide different average fluxes of ions exiting the means for attenuating.

4. A method of mass spectrometry comprising:

providing an ion beam attenuator for attenuating a beam of ions;

cyclically closing and opening the ion beam attenuator to output a pulsed non-continuous beam of ions characterized by a mark space ratio, wherein a closed low-transmission mode of operation blocks the beam of ions from exiting the ion beam attenuator, and an open high-transmission mode of operation allows ions to pass through and exit the ion beam attenuator; and switching between a first attenuation mode of operation wherein the ion beam is attenuated by a first factor associated with a first mark space ratio and a second attenuation mode of operation wherein said ion beam is attenuated by a second different factor associated with a second different mark space ratio, wherein in said closed low-transmission mode of operation the ion transmission is substantially 0% and in said open high-transmission mode of operation the ion transmission is >0%, and wherein the first and second attenuation modes provide different average fluxes of ions exiting the ion beam attenuator.

* * * * *